US007729207B2

(12) United States Patent
Kawaguchi

(10) Patent No.: US 7,729,207 B2
(45) Date of Patent: Jun. 1, 2010

(54) ELECTRONIC TIMEPIECE WITH GENERATOR FUNCTION

(75) Inventor: Takashi Kawaguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 54 days.

(21) Appl. No.: 12/047,034

(22) Filed: Mar. 12, 2008

(65) Prior Publication Data

US 2008/0225648 A1 Sep. 18, 2008

(30) Foreign Application Priority Data

Mar. 14, 2007 (JP) ..... 2007-065647

(51) Int. Cl.
*G04C 10/04* (2006.01)

(52) U.S. Cl. ..... 368/204; 368/64; 368/66

(58) Field of Classification Search ..... 368/64, 368/66, 204
See application file for complete search history.

(56) References Cited

U.S. PATENT DOCUMENTS

| | | | | |
|---|---|---|---|---|
| 6,310,834 | B1 * | 10/2001 | Nosaka | 368/66 |
| 6,343,051 | B1 * | 1/2002 | Yabe et al. | 368/64 |
| 7,113,452 | B2 | 9/2006 | Fujita et al. | |
| 7,358,743 | B2 * | 4/2008 | Miaille | 324/522 |
| 7,471,067 | B2 * | 12/2008 | Tamezane et al. | 320/132 |
| 2003/0146736 | A1 * | 8/2003 | Kosuda et al. | 320/132 |
| 2003/0235117 | A1 | 12/2003 | Ichikawa et al. | |
| 2007/0223318 | A1 * | 9/2007 | Nobs | 368/204 |

FOREIGN PATENT DOCUMENTS

| | | | |
|---|---|---|---|
| CH | 684 623 | A3 | 11/1994 |
| EP | 0 886 197 | A1 | 12/1998 |
| EP | 1 026 559 | A1 | 8/2000 |
| EP | 1 113 348 | A2 | 7/2001 |
| EP | 1 115 043 | A2 | 7/2001 |
| EP | 1 225 489 | A1 | 7/2002 |
| EP | 1 750 182 | A1 | 2/2007 |
| GB | 2 016 749 | | 9/1979 |
| JP | 55-022153 | | 2/1980 |
| JP | 10-319150 | | 12/1998 |
| JP | 2002023285 | | 3/2002 |

* cited by examiner

*Primary Examiner*—Truc T Nguyen
*Assistant Examiner*—Jason Collins

(57) ABSTRACT

An electronic timepiece with a generator function, including a generator, a battery or the like that stores electrical energy produced by the generator, a timekeeping controller that is driven by the stored electrical energy, a time display that is controlled by the timekeeping controller and displays time, a generator output detector that detects peaks of an electrical characteristic of the power generated by the generator, a remaining operating time calculator that integrates the average values corresponding to detected peaks and calculates a remaining operating time, and a remaining operating time display that displays the remaining operating time calculated by the remaining operating time calculator.

22 Claims, 14 Drawing Sheets

| HAND POSITION | 0 | 1 | 2 | 3 | 4 | 5 | 6 | 7 | 8 | 9 | 10 |
|---|---|---|---|---|---|---|---|---|---|---|---|
| DISPLAY VALUE | SLEEP | 0 DAYS | 1 DAY | 2 DAYS | 3 DAYS | 4 DAYS | 5 DAYS | 6 DAYS | 7 DAYS | 14 DAYS | 21 DAYS |

FIG. 7

ELECTRONIC TIMEPIECE WITH GENERATOR FUNCTION

CROSS-REFERENCE TO RELATED APPLICATIONS

Japanese Patent application No. 2007-065647 is hereby incorporated by reference in its entirety. This application is also related to application Ser. No. 12/046,340 filed Mar. 11, 2008.

BACKGROUND

1. Field of Invention

The present invention relates to an electronic timepiece with a power generator function.

2. Description of Related Art

Replacing the battery is not necessary with timepieces that have a power generator function, and such timepieces have therefore come into widespread use.

Electronic timepieces with a power generator function store the power produced by the power generator in a storage means for use. Japanese Examined Patent Pub. JP-A-S61-61077 teaches a timepiece that has a function for indicating the remaining operating time to the timepiece user, and detecting and displaying how much voltage is left in the storage means in order to initiate recharging as may be required.

When a power source with a flat discharge characteristic such as a lithium-ion battery is used as the storage means in the related art described above, the change in the battery voltage over time is small. As a result, accurately displaying the remaining continuous operating time may not be possible even if the battery voltage is detected. More particularly, if the battery voltage varies due to the temperature characteristic or a temporary voltage increase immediately after power generation, the correct remaining operating time cannot be detected even if the battery voltage is detected, and the accuracy of the remaining operating time display drops.

SUMMARY OF INVENTION

An electronic timepiece with a power generating function according to the present invention can correctly detect and display the remaining operating time.

An electronic timepiece with a generator function, including a generating means, a storage means that stores electrical energy produced by the generating means, a timekeeping control means that is driven by the electrical energy stored in the storage means, a time display means that is controlled by the timekeeping control means and displays time, a generator output detection means that detects the power generated by the generating means, a remaining operating time calculation means that integrates the power output detected by the generator output detection means and calculates a remaining operating time, and a remaining operating time display means that displays the remaining operating time calculated by the remaining operating time calculation means.

The generating means can be generator that converts rotational energy to electrical energy when the rotor is turned by a rotary pendulum, a spring, or manually by winding a crown, a solar cell that converts light energy to electrical energy, a thermoelectric generator that generates by means of a temperature differential and converts heat energy to electrical energy, or other type of generator.

The remaining operating time as used herein means the time that driving the electronic timepiece can continue using the electrical energy stored in the storage means, and more specifically means the remaining continuous operating time until the time display means stops displaying the time. If the timekeeping control means rendered by an IC and crystal oscillator stops in an electronic timepiece with a power generator function, the storage means must be recharged to the voltage at which driving the IC can start, a specific amount of time is required for operation of the crystal oscillator to stabilize, and restarting operation of the timekeeping control means is therefore relatively time-consuming. A sleep mode is therefore usually activated when the voltage stored in the storage means drops to a prescribed level so that driving only the IC and crystal oscillator of the timekeeping control means continues and driving the time display means, which typically includes an indicator and motor or liquid crystal display, stops. The remaining operating time of this electronic timepiece with a generator function therefore means the remaining continuous operating time until the sleep mode is activated.

Furthermore, because the invention integrates the generator output instead of detecting the voltage of the storage means, the electrical energy charged to the storage means can be detected with good precision, and the remaining operating time can be accurately displayed even if a secondary battery with a flat discharge characteristic is used as the storage means.

Preferably, the generator output detection means can be chosen according to the type of generating means that is used, but preferably can detect the output power of the generating means in real time.

For example, if a generator that produces power by driving a rotor to change the magnetic flux crossing the coil is used as the generating means, the output current produced by the generator is an AC current, and a current detection means that detects the output current rectified by a full-wave rectifier circuit can be used.

Preferably, the remaining operating time calculation means predetermines the current consumption per prescribed time of the electronic timepiece, and has a remaining operating time counter that increments the remaining operating time by this prescribed time each time the generator output detection means detects generator output equivalent to this current consumption per prescribed time.

The current consumption per unit time by the electronic timepiece when displaying the time is substantially constant if other special functions, such as driving a light or measuring time with a chronograph function, are not used, and can therefore be predetermined. The remaining operating time calculation means can therefore add one minute to the remaining operating time counter if, for example, power equal to the current consumed in one minute is generated. The remaining operating time display means can then read the count stored by the remaining operating time counter to display the remaining operating time.

This aspect of the invention can determine the remaining operating time with high precision because the remaining operating time is incremented a prescribed time when power equal to the current consumption of the electronic timepiece per prescribed time is generated. Processing also requires only the simple algorithm of adding a prescribed time to the count of the remaining operating time counter when a preset generator output equal to the current consumption per prescribed time is detected.

In another aspect of the invention the remaining operating time calculation means preferably decreases the count stored by the remaining operating time counter by a prescribed time each time the prescribed time passes when the timepiece movement continues operating, and the timekeeping control means stops driving the time display means when the count of the remaining operating time counter goes to 0.

The remaining operating time counter is thus incremented according to how much power is generated when the generating means produces power, and is decremented based on the passage of time if the movement of the timepiece is operating. The count stored by the remaining operating time counter therefore reflects both charging the storage means and power consumption, can be kept to a value corresponding to the electrical energy stored in the storage means, and enables displaying the remaining operating time with good precision.

Furthermore, when the count of the remaining operating time counter goes to 0, the timekeeping control means stops driving the time display means and enters a sleep mode. The actual remaining operating time (how much time is left until the sleep mode is entered) therefore completely matches the displayed remaining operating time, the user can accurately know how much time is left until the movement stops, and convenience is improved.

Because the remaining operating time counter increments when the generator output detection means and remaining operating time display means are operating, that is, when the voltage of the storage means is greater than or equal to a prescribed level and the electronic timepiece is operating normally, the storage means still stores sufficient voltage for the electronic timepiece to operate normally when the count of the remaining operating time counter goes to 0. Therefore, while restoring a voltage enabling the IC to operate is difficult when the storage means has completely discharged, the invention keeps the voltage of the storage means to a prescribed level or higher. Operation can therefore be quickly restored from the sleep mode to a stable operating mode when power is generated, the user can quickly know the time, and convenience is improved.

In an analog timepiece that uses a motor to move hands and display the time, and in a digital timepiece that displays the time on a liquid crystal display, putting the time display means into the sleep mode as used herein refers to either a partial sleep mode in which the internal timekeeping operation of the timepiece continues but driving the hands or display stops, or a full sleep mode in which the oscillation means also stops and the internal timekeeping counter of the timepiece also stops.

The partial sleep mode has the advantage of enabling the timepiece to automatically and easily restore the current time when power is generated. On the other hand, while the time must be reset when the movement resumes operation if the full sleep mode is selected, power consumption is further reduced compared with the partial sleep mode, and the time until the storage means is fully discharged is longer.

In another aspect of the invention the remaining operating time calculation means preferably uses an integer multiple or a 1/integer fraction of the current consumption by the electronic timepiece per prescribed time as the integration unit, converts the power output detected by the generator output detection means to integration units, and integrates generator output based on the integration unit to calculate the remaining operating time.

This aspect of the invention can calculate the remaining operating time from the increase or decrease in integration units, and the process and circuitry can therefore be simplified.

Particularly if the integration unit is an exponent of 2 (2, 4, 8, . . . $2^n$) or is 1/(an exponent of 2) (½, ¼, ⅛, . . . $½^n$) of the power consumption in a prescribed time (where n is an integer or 1 or more), binary processing is simplified, processing by an IC is simple, and the process and circuitry can be further simplified.

In another aspect of the invention the generator output detection means preferably samples the output current, detects the peak of each sampling period, and retrieves an average current value corresponding to the peak from a precompiled table of output current peak values and corresponding average current values as the generator output, and the remaining operating time calculation means integrates the average current value to calculate the remaining operating time.

If the generator output detection means detects the peak, the need for a capacitor is eliminated and the hardware configuration is simplified while enabling integrating the average current corresponding to the actual charge current, and generator output can be accurately integrated.

In another aspect of the invention the remaining operating time calculation means preferably does not continue integrating generator output if the stored integral has reached an upper limit.

This upper limit is set to the maximum value that can be displayed by the display unit, or to the sum of this maximum value plus a prescribed amount.

This aspect of the invention enables shifting the voltage range of the secondary battery or other storage means that is used to the high voltage side, and can thereby reduce the risk of a total discharge. More specifically, if an upper limit for the integral is not set when power generation and generator output integration start when the storage means is at a certain initial voltage, the storage means will return substantially to the original initial voltage when the remaining operating time goes to 0 because there is no upper limit to the remaining operating time based on the integral, and the lower end (low voltage side) of the used voltage range of the storage means will remain substantially constant. As a result, if the initial voltage starts at a relatively low level, and current consumption is greater than during normal operation when only the movement is driven because of a load variation or the user used some function, the voltage of the storage means could drop to below the initial voltage before the remaining operating time goes to 0, and the storage means could discharge completely.

However, by setting an upper limit for the integral, that is, the remaining operating time, the used range of the storage means shifts to the high voltage side. As a result, even if current consumption is greater than normal when only the movement is driven, the risk of a total discharge can be reduced because there is a margin of error before the storage means discharges completely.

Furthermore, if an upper limit is not set for the integral and the user continues generating power even after the integral rises to a value corresponding to the maximum value that can be displayed by the display unit, the integral or remaining operating time will also become greater than the maximum display value. This means that after generation stops and the remaining operating time is decreased by driving the movement, the display will not change until the integral (remaining operating time) decreases to the maximum display value, and the user might think that the display is broken. For example, if the maximum remaining operating time that can be displayed on the display unit is 10 days, generator output increases to a 15-day charge, and the remaining operating time is integrated to 15 days, the display unit will continue indicating a remaining operating time of 10 days until five days pass without generating power and the remaining operating time decreases to 10 days. As a result, the user could erroneously think that a failure has occurred because the remaining operating time display does not change.

The invention therefore stops integration when the integral, that is, the remaining operating time, rises to an upper limit, which could be the maximum display value of the display unit (such as 10 days), or the maximum display value (such as 10 days) plus a prescribed value (such as 1 day). As a result, the display changes one day after generation stops and the movement starts. The user can therefore reliably know that the remaining operating time has changed, and can be prevented from thinking that a malfunction occurred.

When the upper limit is set by adding a prescribed value to the maximum display value, the prescribed value is preferably within the operating time between the maximum display value of the display unit and the first preceding graduation. For example, if the maximum value is 10 days and the preceding graduation is 8 days, the prescribed value is the difference of 2 days.

With this arrangement the user will think that operation is normal even if the display does not change for the time of one graduation (two days in this example), and can be prevented from thinking that a malfunction has occurred because the display changes after two days.

In another aspect of the invention the remaining operating time calculation means preferably multiplies the generator output detected by the generator output detection means by a prescribed coefficient and integrates the result to calculate the remaining operating time.

If the voltage of the storage means is less than or equal to a prescribed voltage, this prescribed coefficient is preferably a coefficient less than 1. This prescribed voltage is higher than the maximum voltage of the normal voltage range that is used in the secondary battery or other storage means.

By thus integrating the generator output (charge) by multiplying a prescribed coefficient, the invention can adjust the relationship of the electrical energy actually charged to the storage means to the remaining operating time that is based on the integral. For example, if the coefficient is less than 1, the remaining operating time is less than the actual charge proportionally to the coefficient. If the coefficient is 0.8, for example, and the actual charge is equivalent to an operating time of 10 days, the integral output by the integration unit will be an operating time of 8 days. As a result, when the remaining operating time based on the integral goes to 0, the storage means still stores electrical energy equivalent to at least 2 days, the used voltage range of the storage means can be shifted to the high voltage side, and timepiece operation can be prevented from stopping before the remaining operating time goes to 0.

In addition, the remaining operating time can be corrected based on the charging efficiency of the storage means by applying a prescribed coefficient to integrate the generator output, and the remaining operating time can thus be appropriately calculated while continuing to efficiently charge the battery.

In another aspect of the invention the remaining operating time calculation means preferably can separately calculate a first integral and a second integral, and the remaining operating time display means can switch between displaying the first integral and the second integral. The first integral integrates generator output from when the timekeeping control means starts and the remaining operating time is reset to 0, and the second integral integrates generator output from when a prescribed operation occurs.

This aspect of the invention enables accurately determining the remaining operating time using the first integral, and accurately determining the operating time resulting from generator output after a particular operation is performed using the second integral.

For example, if the user generates power manually and the integral of generator output since manual generation starts is calculated as the second integral, how much operating time has been added by the generating operation can be determined, and the user can accurately confirm generator output when the user generates power manually.

In another aspect of the invention the remaining operating time display means preferably uses a larger display unit to display the remaining operating time when the remaining operating time calculated by the remaining operating time calculation means is greater than a prescribed time than when the calculated remaining operating time is less than the prescribed time.

For example, if the remaining operating time is less than or equal to 1 day, the remaining operating time is displayed in hour units (1, 2, to 24 hours). If the remaining operating time is greater than 1 day and less than or equal to 7 days, the remaining operating time is displayed in day units. If the remaining operating time is greater than 7 days, the remaining operating time is displayed in 7-day units (7 days, 14 days, 21 days, and so forth).

Because the remaining operating time indicates how long the timepiece can continue operating, displaying the remaining operating time with increasing precision when the remaining operating time becomes shorter enables the user to accurately know the remaining operating time and convenience is improved.

If the remaining operating time display means is a liquid crystal display or display means that can display numbers, the remaining operating time can be displayed digitally in each of the foregoing units.

If the remaining operating time display means is an analog display having a dial with graduations to which the hand points and a hand driven by a stepping motor or other means, or a hand and analog dial that are displayed on the LCD, for example, the graduations can be set based on the foregoing units.

An analog display generally has a hand driven by a motor, but a hand or an indicator such as a bar that varies in length instead of a hand can be presented on a display. The drive control unit therefore usually has a motor that drives the hand and a motor drive unit, but is a screen display control means if a hand or an indicator such as a bar is presented on a display.

In another aspect of the invention the remaining operating time display means preferably displays differently than the normal remaining operating time display when the remaining operating time calculated by the remaining operating time calculation means is 0 or less.

If the display unit is an analog display having a hand, for example, the hand can point to a different position than the graduations used for indicating the remaining operating time. If the display unit is a digital display that presents numbers, for example, symbols other than numbers can be displayed.

The display unit that displays the remaining operating time prompts the user to recharge the battery when the remaining operating time becomes short. Therefore, if the remaining operating time is between 0 and the minimum display unit (such as 3 hours), the hand preferably points to 0 or the number 0 is displayed. If the display unit points to graduation 0 in this case, it is difficult to know if the remaining operating time is somewhere between 0 and 3 hours or if the remaining operating time is actually 0.

The invention therefore points to 0 in this case if the remaining operating time is between 0 and 3 hours. When the actual remaining operating time goes to less than 0 hours, the invention points the hand to a graduation at a position offset from the 0 graduation or displays a symbol that is different from the number 0 so that the user easily knows that the remaining operating time is less than or equal to 0 and the electronic timepiece has entered the sleep mode.

In another aspect of the invention the timekeeping control means preferably stops the time display means and continues keeping the time when the remaining operating time is less than or equal to 0, and drives the time display means and resumes displaying the current time when power is generated and the remaining operating time becomes greater than 0.

Because this aspect of the invention continues keeping the time when remaining operating time is less than or equal to 0, the user does not need to reset the time when power is generated and operation resumes, and convenience is improved. While driving the timekeeping control means, which requires only a crystal oscillator and IC, continues, power is saved because the time display means, which has relatively high power consumption due to driving the motor or display, is stopped. The time until the storage means is fully discharged can therefore be increased compared with continuing to drive the time display means, and there is a higher possibility of restoring normal operation by recharging the battery.

In another aspect of the invention the time display means preferably includes a motor drive means, a motor that is driven by the motor drive means, and a hand that is moved by the motor, the motor drive means can execute a drive correction process to detect motor rotation after inputting a drive pulse to the motor, and input a drive correction pulse to turn the motor if motor rotation is not detected, and the remaining operating time calculation means corrects the remaining operating time based on how many times the drive correction process was executed.

If the motor drive means is configured to run a drive correction process, power consumption can be reduced during normal operation by using a drive pulse with a short pulse width, and the motor can reliably be caused to turn by inputting a drive correction pulse with a greater pulse width only when the motor cannot be driven by the short pulse width drive pulse due to a variation in load, for example. When this drive control method is used and the drive correction process is executed, current consumption rises accordingly.

Therefore, if power consumption is set and the remaining operating time is calculated based on driving the motor using only the normal drive pulse, the storage means voltage is reduced by the current consumption of the drive correction process and the timekeeping operation may stop before the remaining operating time display goes to 0.

To prevent this from happening, the integration unit of the invention applies correction based on the number of times the drive correction process is executed. The remaining operating time can therefore be corrected to account for the current consumed by the drive correction process, and operation can reliably be prevented from stopping before the remaining operating time goes to 0.

In another aspect of the invention the remaining operating time calculation means preferably can correct the integral of generator output.

This aspect of the invention enables correcting the integral according to the actual current consumption of the individual product when there is variation in the current consumption per unit time in individual products. As a result, measurement error, that is, remaining operating time error, caused by individual product differences can be reduced.

For example, if the current consumption of a particular product is 1.2 times the current consumption of the reference product per prescribed time (such as one day), and the current consumption of the reference product is used as the reference current consumption used to calculate the remaining operating time, the calculated remaining operating time will be longer than the actual remaining operating time of the actual product. For example, if the remaining operating time calculated using the current consumption of the reference product is 10 days and the actual current consumption of the product is 1.2 times the reference, the actual remaining operating time will be 10 days/1.2=8.3 days and the calculated remaining operating time will be longer than it actually is.

If in this case the integral of the generator output is set to 1/1.2=0.833 times, for example, the remaining operating time calculated from the generator output will match the actual remaining operating time of the product, and the remaining operating time can be accurately calculated and displayed.

In another aspect of the invention the remaining operating time calculation means preferably detects the voltage of the storage means, and corrects the integral to a value corresponding to an operating time based on the detected voltage if the remaining operating time estimated based on the detected voltage is shorter than the remaining operating time based on the integral calculated by the remaining operating time calculation means.

This aspect of the invention can further improve the accuracy of the remaining operating time because the remaining operating time obtained by integrating the generator output can be verified by the remaining operating time based on the actual voltage of the storage means, and the remaining operating time based on the integral can be corrected with reference to the remaining operating time based on the detected voltage.

In another aspect of the invention the remaining operating time calculation means preferably detects the voltage of the storage means, and corrects the value added for integration based on the generator output if the detected voltage is greater than or equal to a prescribed voltage.

For example, if the prescribed voltage is set to voltage V1 that is higher than the usable voltage range of the storage means where the discharge characteristic is substantially flat, when the voltage of the storage means goes to voltage V1 or higher, the remaining operating time calculation means can integrate a value equal to twice the generator output (charge).

The generating efficiency of a self-winding generator, manual winding generator, or solar cell drops when the voltage of the secondary battery or other storage means is high. The displayed remaining operating time therefore does not necessarily increase when power is generated.

As a result, when the voltage of the storage means is greater than or equal to a prescribed voltage V1, the invention doubles or otherwise corrects the generator output that is added to the remaining operating time calculation means. This causes the remaining operating time to appear to increase even if the rate of increase in the generator output is low, and the remaining operating time display will continue to change.

In addition, because the increase in the remaining operating time relative to the voltage rise can be increased in the high voltage range of the storage means, the voltage range of the battery that is actually used can be prevented from shifting further to a higher voltage.

In another aspect of the invention the generator output detection means preferably sets the detection level according to the generating pattern of the generating means.

For example, if a plurality of generating methods that produce greatly different output (generated current) are used in a single product, the detection level can be set appropriately to the generating method that is presently used by detecting the generation pattern, and the charge can be accurately integrated while simplifying the system.

In another aspect of the invention the generator output detection means preferably changes the detection level if a prescribed generator output is detected.

This aspect of the invention enables switching the detection level when generator output (output current) reaches a prescribed level, and the display can therefore also be changed quickly as a result of changing the detection level. More particularly, if only one type of generating means is used, generator output rising to the prescribed level means that the generation state of the generating means has changed. Generator output detection precision can therefore be improved by changing the detection level according to the generation state.

In another aspect of the invention the generator output detection means preferably changes the detection level when a state in which generating a prescribed output power within a prescribed time continues for a prescribed time or longer.

This aspect of the invention changes the detection level when power is generated at a specific level continuously for a certain period of time. The detection level can therefore be changed appropriately to generator output and the output power can be reliably detected when a prescribed charge is produced continuously for an extended time, such as when a solar generator or a generator that uses an external AC field is used as the generating means.

In another aspect of the invention the generator output detection means preferably changes the detection level when a prescribed output level in one generation cycle occurs a prescribed number of times within a prescribed period.

When the timepiece has both a self-winding generator that turns the rotor of the generator by means of a rotary pendulum, and a manually wound generator in which the rotor of the generator is turned by the user winding the crown, for example, generator output is not particularly high when the self-winding generator outputs power intermittently in the course of the timepiece being simply used normally. The detection level is therefore held low because this aspect of the invention only changes the detection level when a prescribed generator output is detected a plurality of times. However, when the user intentionally shakes the wrist on which the electronic timepiece is worn to drive the self-winding generator and charge the battery, or winds the crown to generate power, the possibility is high that the condition defined above is met, the detection level can be automatically changed, and generator output can be detected with good precision.

In another aspect of the invention the generator output detection means preferably changes the detection level when a prescribed output level is generated in one generation cycle and generating the prescribed output level is then detected within a prescribed time.

This aspect of the invention only changes the detection level when a prescribed output level is generated in one generation cycle and generating the prescribed output level is then detected within a prescribed time. When the timepiece has both a self-winding generator that turns the rotor of the generator by means of a rotary pendulum, and a manually wound generator in which the rotor of the generator is turned when the user winds the crown, for example, the detection level does not change easily when the electronic timepiece is simply being worn. The detection level can be changed when the user intentionally drives the generator, however, and generator output can therefore be detected with good precision.

An electronic timepiece according to another aspect of the invention preferably also has an external operating member, and the integral of the remaining operating time calculation means is initialized to a value for a prescribed remaining operating time greater than 0 when there is a specific operation of the external operating member.

The integral can be initialized to a value resulting in a remaining operating time of 10 minutes, for example. If the integral is initialized to 0, denoting a remaining operating time of 0, during after-sale service or when the system is initialized due to a system error, for example, the timepiece will stop the movement and not return to the usable state. However, if the integral is initialized to a prescribed remaining operating time greater than 0, such as a remaining operating time of 10 minutes, the movement will immediately resume operation, the timepiece can be restored to the normal operating mode, and convenience is improved.

An electronic timepiece according to another aspect of the invention preferably also has an external operating member, and the voltage of the storage means is detected, and the integral of the remaining operating time calculation means is initialized to a value based on the detected voltage when there is a specific operation of the external operating member.

If the voltage of the storage means is greater than or equal to a prescribed level, this aspect of the invention can immediately resume operation of the movement, restore the normal operating mode, and thus improve convenience.

Furthermore, if the integral is initialized to a preset value when a specific operation occurs, the integral will be initialized to the prescribed value even if the voltage of the storage means is insufficient. This aspect of the invention prevents this problem and can display the correct remaining operating time based on the voltage because the integral is also set to 0 or below according to the detected voltage.

An electronic timepiece with a power generating function according to the present invention has the effect of enabling correctly detecting and displaying the remaining operating time.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 7 shows the relationship between hand position and the display value in the first embodiment of the invention.

DESCRIPTION OF THE PREFERRED EMBODIMENTS

A first embodiment of the present invention is described below with reference to the accompanying figures.

General Configuration of the Electronic Timepiece

Figure 1:
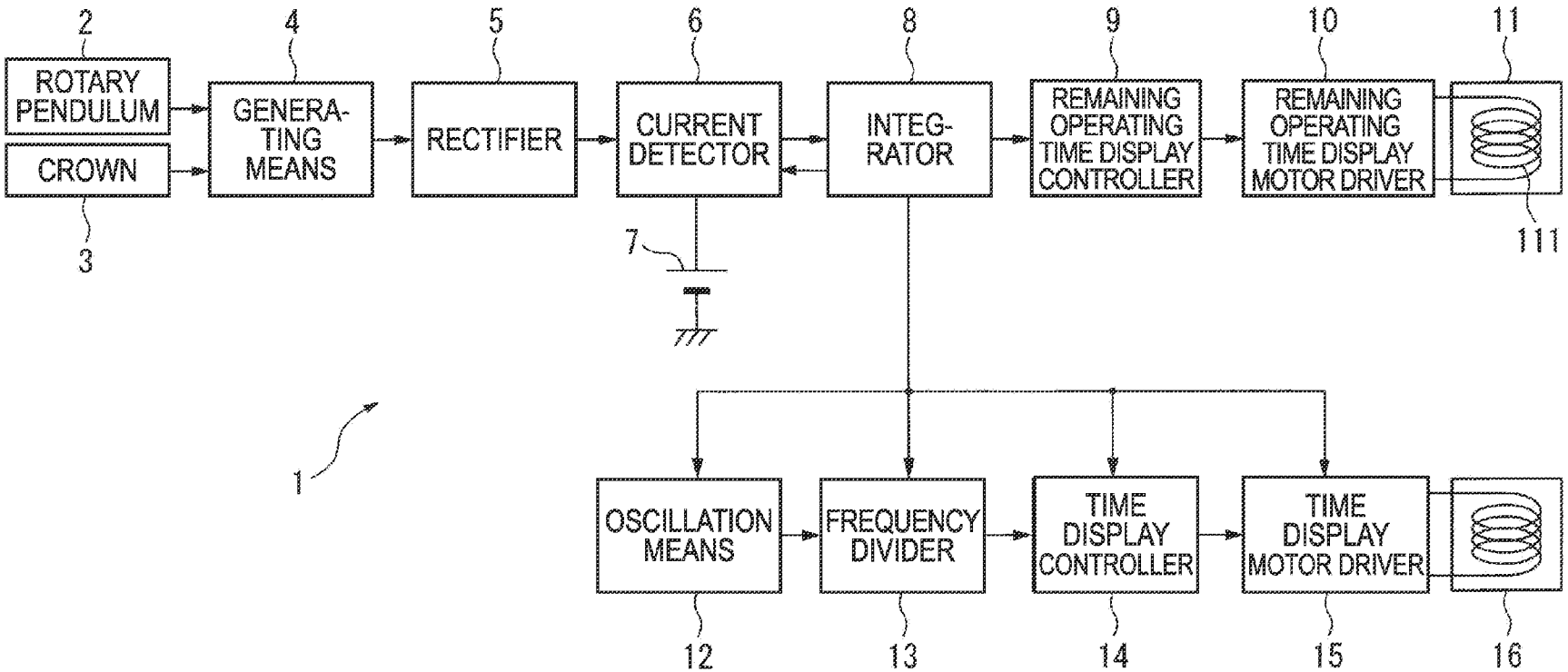
FIG. 1 is a block diagram of an electronic timepiece with a generator function according to a first embodiment of the present invention.

As shown in FIG. 1, an electronic timepiece 1 according to the present invention has a rotary pendulum 2, a crown 3, a generating means 4, a rectification means 5, a current detection means 6, a storage means 7 as a power storage means, an integration means 8, a remaining operating time display control means 9, a remaining operating time display motor driving means 10, a remaining operating time display motor 11, an oscillation means 12, a frequency division means 13, a time display control means 14, a time display motor driving means 15, and a time display motor 16.

Figure 2:
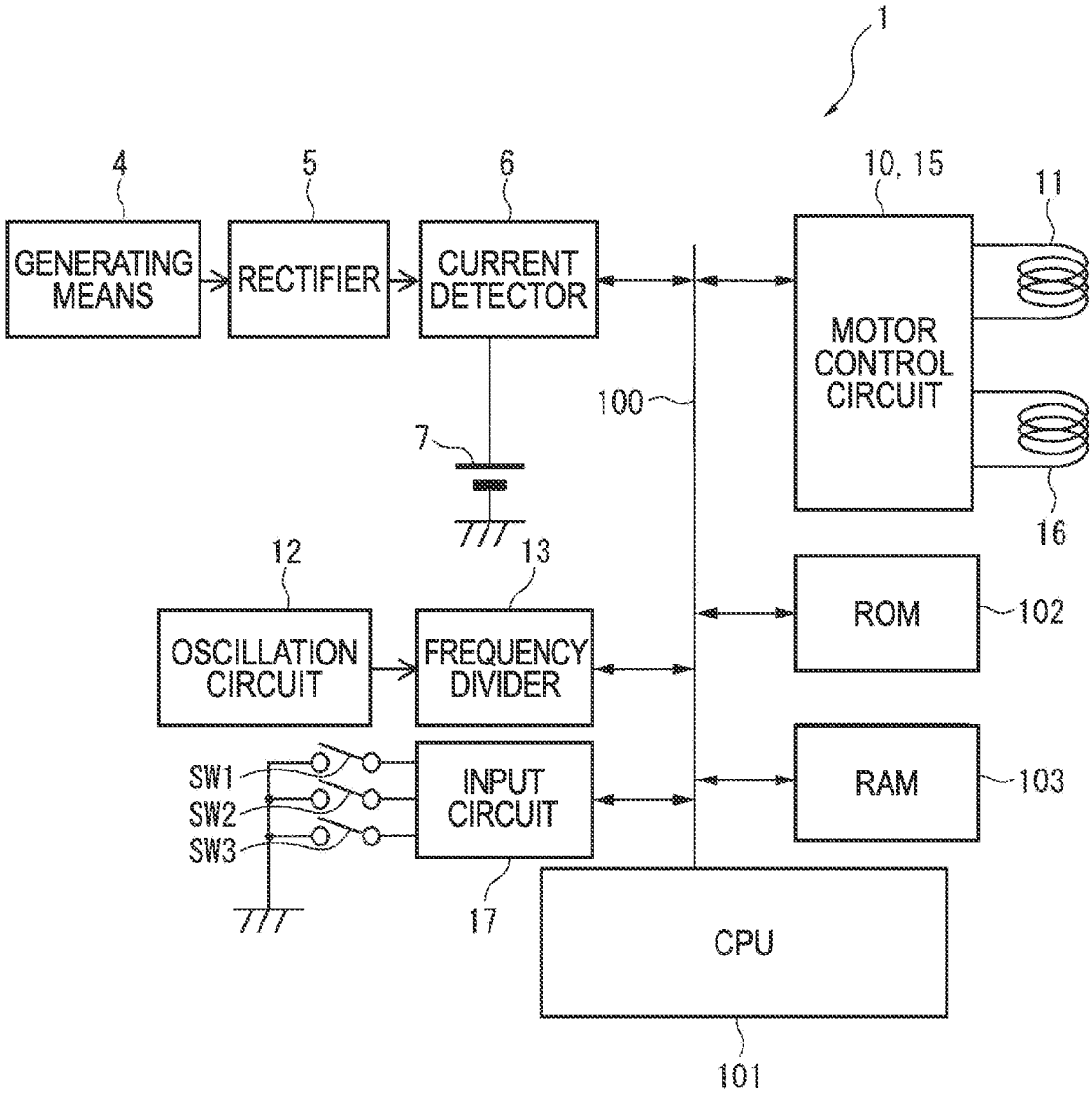
FIG. 2 is a circuit block diagram of the electronic timepiece in the first embodiment of the invention.

As shown in the hardware schematic in FIG. 2, the current detector 6 (current detection circuit), frequency divider 13 (frequency division circuit), and the motor drive means 10 and 15 (motor control circuits) are connected to a CPU 101 (central processing unit), ROM 102 (read-only memory), and RAM 103 (random access memory) by a bus 100 to enable data input and output therebetween.

In this embodiment of the invention the integrator 8, remaining operating time display controller 9, and time display controller 14 are achieved by running specific software applications using the CPU 101, ROM 102, and RAM 103.

An input circuit 17 is also connected to the bus 100 as shown in FIG. 2. Switches SW1 to SW3 are connected to the input circuit 17. Switches SW1 and SW2 are on a circuit board to which an IC containing the CPU 101, ROM 102, and RAM 103 is mounted, and are selectively set after testing the characteristics of the individual electronic timepiece 1 in the electronic timepiece 1 factory, for example.

One switch SW3 is operated when the user operates a push-button or other externally operable operating member.

The input circuit 17 detects the on/off state of each of the switches SW1 to SW3 and stores the state of each of the switches SW1 to SW3 in RAM 103.

Figure 3:
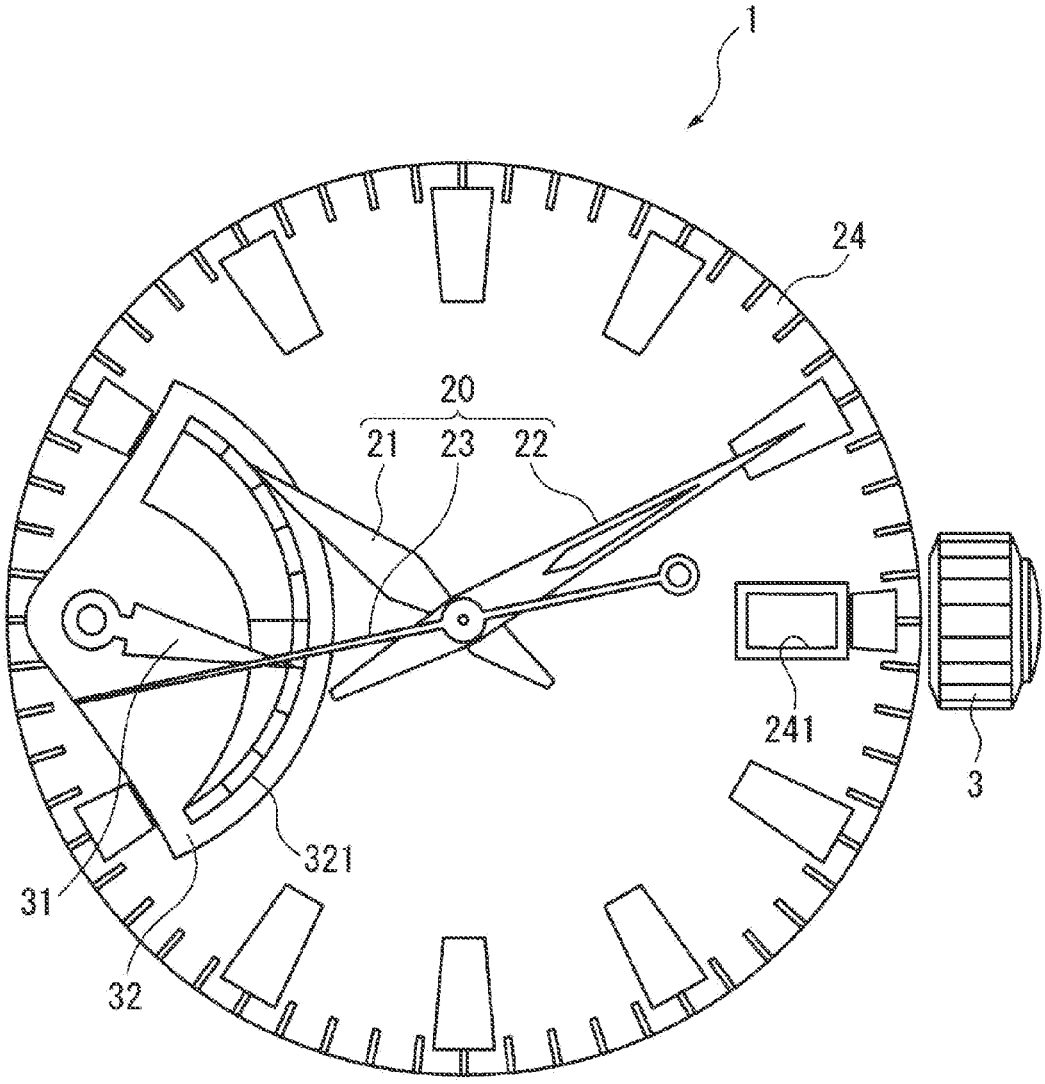
FIG. 3 shows the dial portion of the electronic timepiece in the first embodiment of the invention.

As shown in FIG. 3, the electronic timepiece 1 has hands 20 including an hour hand 21, a minute hand 22, and a second hand 23 for indicating the time. The hands 20 are driven by the time display motor 16.

A remaining operating time dial 32 and a display hand (auxiliary hand) 31 that is separate from the hands 20 for indicating the time and is used to indicate the remaining operating time are disposed at the 9:00 o'clock position on the dial 24 of the electronic timepiece 1. The display hand 31 is driven by the remaining operating time display motor 11.

A window 241 is formed at the 3:00 o'clock position of the dial 24, and the date can be displayed by a date wheel disposed behind the dial 24. The date wheel is driven rotationally by a date wheel motor not shown.

In the electronic timepiece 1 thus comprised the timepiece control means of the invention is rendered by the oscillation means 12, the frequency divider 13, and the time display controller 14, and the time display means is rendered by the time display motor driver 15, the time display motor 16, and the hands 20.

The generated output detection means of the invention includes the current detector 6, the remaining operating time calculation means includes the integrator 8, and the remaining operating time display means includes the remaining operating time display controller 9, the remaining operating time display motor driver 10, the remaining operating time display motor 11, the display hand 31, and the remaining operating time dial 32. The hand of the remaining operating time display means is rendered by the display hand 31, and the actuator is rendered by the remaining operating time display motor driver 10 and the remaining operating time display motor 11.

Power Generation Means

Figure 4:
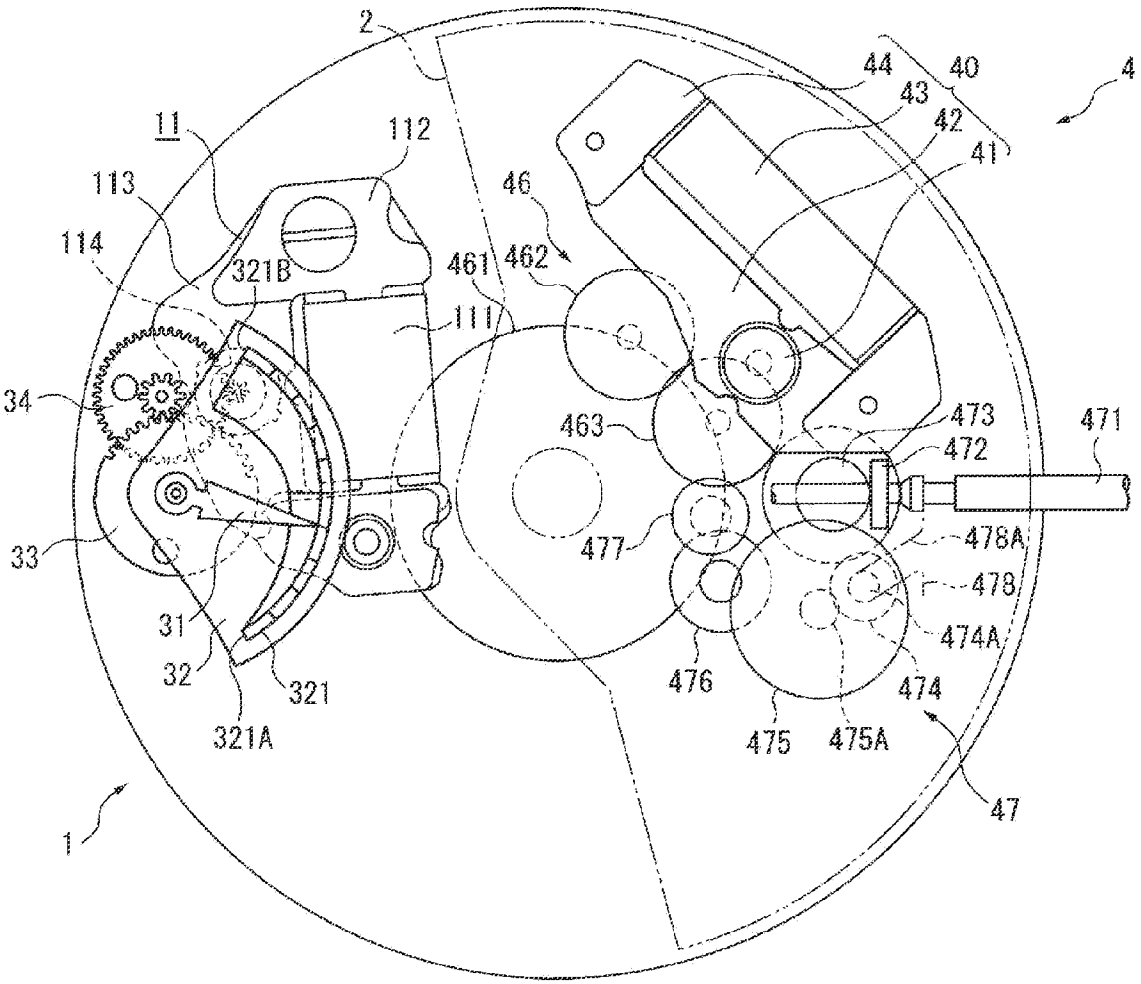
FIG. 4 shows the arrangement of the generating means and the remaining operating time display means in the first embodiment of the invention.
Figure 5:
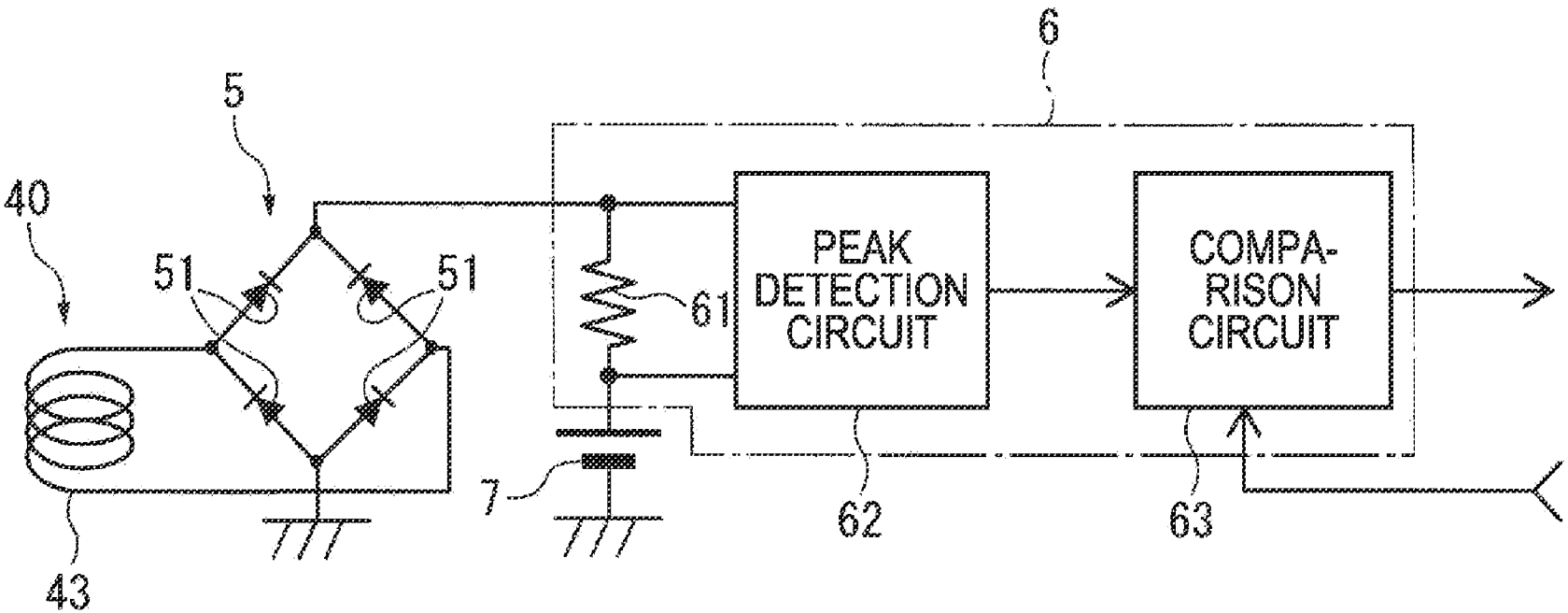
FIG. 5 is a circuit diagram showing of the rectifier means and current detection means in the first embodiment of the invention.

As shown in FIG. 4, the generating means 4 enables generating power using a self-winding generator that is driven by the rotary pendulum 2 disposed inside the case of the electronic timepiece 1, or using a manually wound generator that is driven by the crown 3.

More specifically, the generating means 4 includes a generator 40, a self-winding transfer means 46, and a manual winding transfer means 47. The self-winding transfer means 46 transfers mechanical energy from the rotary pendulum 2 to the generator 40. The manual winding transfer means 47 transfers mechanical energy from the crown 3 to the generator 40.

The generator 40 is a common alternating current generator including a rotor 41, a stator 42, a coil 43, and a coil block 44. The rotor 41 is rotatably disposed to the stator 42, and the coil 43 is wound to the coil block 44.

The self-winding transfer means 46 includes a rotary pendulum wheel 461 that rotates in unison with the rotary pendulum 2, and a pair of switching wheels 462 and 463 to which rotation of the rotary pendulum wheel 461 is transmitted. One switching wheel 463 meshes with the pinion of the rotor 41 so that torque from the rotary pendulum 2 is transferred through the rotary pendulum wheel 461 and switching wheels 462 and 463 to the rotor 41 so that the generator 40 produces power.

The pair of switching wheels 462 and 463 have a ratchet wheel not shown so that the rotor 41 only turns in one direction regardless of which direction the rotary pendulum wheel 461 turns.

The manual winding transfer means 47 includes a winding stem 471, a winding pinion 472, a crown wheel 473, a clutch wheel 474, a first manual winding transfer wheel 475, a second manual winding transfer wheel 476, a third manual winding transfer wheel 477, and the switching wheel 463.

The crown 3 is attached to the end of the winding stem 471 so that the winding stem 471 turns when the user turns the crown 3. Rotation of the winding stem 471 is transmitted to the clutch wheel 474 by the intervening winding pinion 472 and crown wheel 473, rotation of the clutch wheel 474 is transmitted to the first manual winding transfer wheel 475, and rotation of the first manual winding transfer wheel 475 is transmitted to the switching wheel 463 by the intervening second manual winding transfer wheel 476 and third manual winding transfer wheel 477.

The clutch wheel 474 engages the pinion 475A of the first manual winding transfer wheel 475 only when the winding stem 471 turns in one direction. More specifically, a slot 478A is formed in the bridge 478 to which the clutch wheel 474 is disposed, and the support pin 474A of the clutch wheel 474 is fit freely slidably in this slot 478A. Referring to FIG. 4, when the stem is wound and the crown wheel 473 turns clockwise, the clutch wheel 474 rotates counterclockwise while moving toward the center of the first manual winding transfer wheel 475 to engage the pinion 475A. When the first manual winding transfer wheel 475 turns counterclockwise due to drive power from the switching wheel 463, the clutch wheel 474 separates from the pinion 475A while turning clockwise and thus disengages the first manual winding transfer wheel 475. As a result, rotation of the rotary pendulum 2 is not transmitted to the winding stem 471.

Rectification Means

The rectifier 5 rectifies the AC current output from the generator 40, and can be rendered using a known rectification circuit such as a full-wave rectifier circuit or a half-wave rectifier circuit.

In this embodiment of the invention the rectifier 5 is rendered by a bridge rectification circuit (full-wave rectifier circuit) using four diodes 51.

Current Detection Means

The current detector 6 detects the level of the current rectified by the rectifier 5.

More specifically, the current detector 6 has a resistor 61, a peak detection circuit 62, and a comparison circuit 63. The resistor 61 is disposed between the rectifier 5 and the storage means 7. The peak detection circuit 62 measures the current flowing through the resistor 61 and detects the current generation peak. The comparison circuit 63 then compares the peak value detected by the peak detection circuit 62 with a threshold value.

The current detector 6 is driven at a prescribed sampling rate (sampling period) by a signal from the CPU 101 and samples the charge current charged to the storage means 7.

Figure 6:
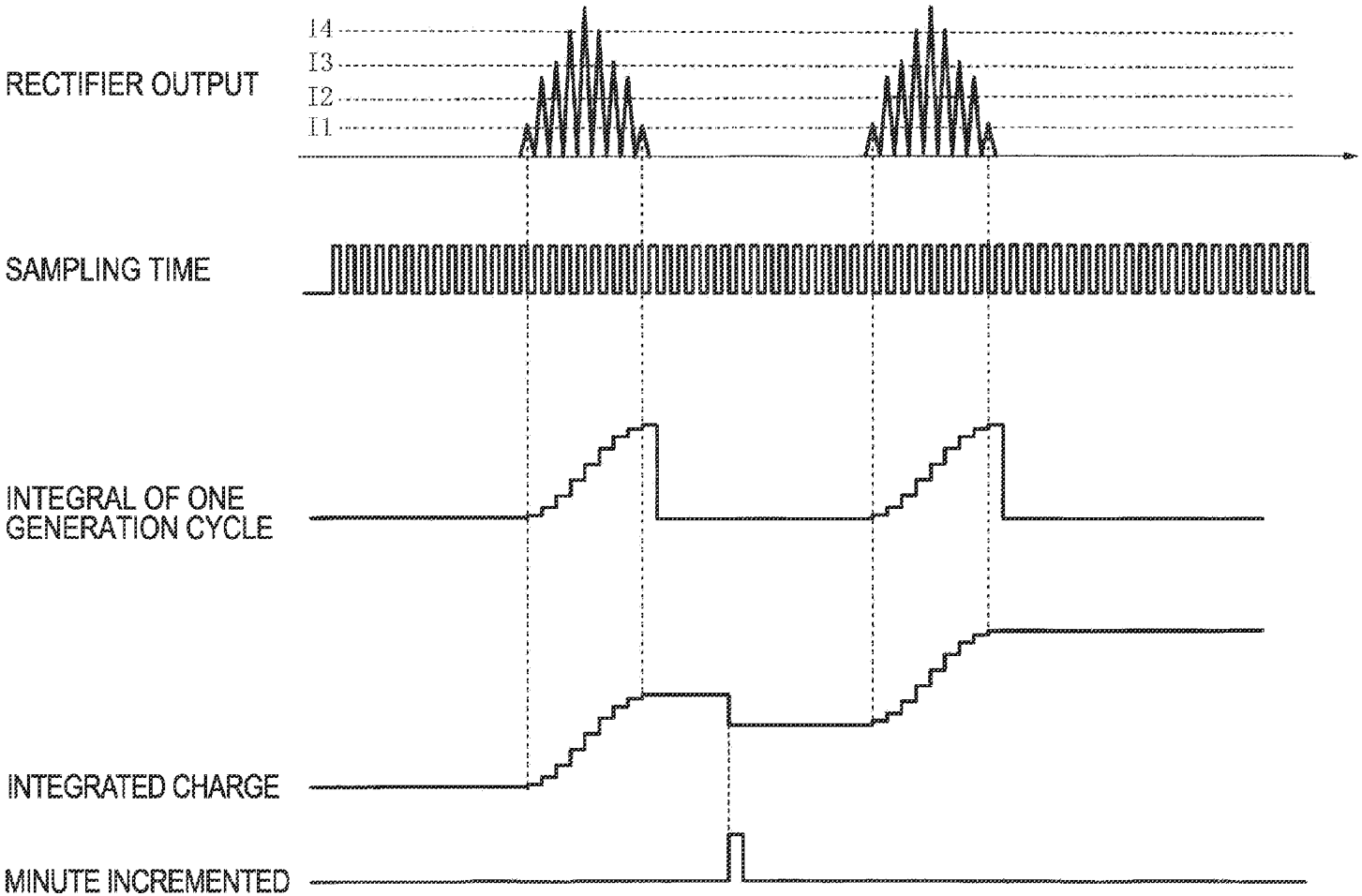
FIG. 6 is a timing chart showing the relationship between power generation, the integral of one power generation cycle, and the accumulated charge in the first embodiment of the invention.

As shown in FIG. 6, the peak detection circuit 62 samples the generated current output from the rectifier 5 and detects the peak value of each sample. The comparison circuit 63 compares the peak value detected by the peak detection circuit 62 with prescribed threshold values, such as threshold values I1 to I4 in FIG. 6, and outputs a detection result signal to the integrator 8 and the remaining operating time display controller 9.

Note that in FIG. 6 one group of waves (group of waves shaped like a mountain peak) in the rectification circuit output corresponds to the charge current wave produced by winding the crown 3 once.

The comparison circuit 63 in this embodiment of the invention is arranged so that the threshold value level, that is, the detection level, can be changed by a signal from the CPU 101 based on the integral of the integrator 8, for example.

Power Storage Means

The power storage means of the invention is rendered by a secondary battery 7 that can be charged by the generated current. The output of the generator 40 is rectified by the rectifier 5 and stored in the secondary battery 7 through the intervening current detector 6. The power storage means is not limited to a secondary battery 7, and a capacitor can be used instead.

Integration Means

The integrator 8 calculates the average current based on the detection result signal output from the current detector 6, and integrates the average current values.

More specifically, the relationship between the generated current peak detected from each sample and the average current level at each peak is predetermined experimentally, and stored in a correlation table in ROM 102. The integrator 8 finds the average current level corresponding to the detection result signal (peak) output from the current detector 6, and integrates the average current values.

The integrator 8 has a power generation counter, a first continuous operating time counter, and a second continuous operating time counter. The counters are rendered in RAM 103.

As indicated by the "integral of one power generation cycle" in FIG. 6, the power generation counter is a counter that integrates the average current each time power is generated and stores the integral (generated power output) of the single generation cycle. As described below in the second embodiment, this counter is provided because one condition for changing the power output detection level in this embodiment is whether the power output from the one generation cycle integrated by the power generation counter is greater than or equal to a threshold value Q1.

The first remaining operating time counter counts a first integral that accumulates the output power after the timekeeping control means starts and the remaining operating time is reset to 0.

More specifically, as indicated by the cumulative charge value in FIG. 6, the first remaining operating time counter counts the continuous operating time of the electronic timepiece 1, and steps up the continuous operating time that is displayed during normal operation a one-day increment each time the integral of the generated current (generated power) reaches the preset value for the amount of power to be generated in one day. When current consumption by the electronic timepiece 1 reaches the amount consumed in one day, the cumulative value stored in the continuous operating time counter is reduced, and the continuous operating time display is stepped down a one-day increment each time the continuous operating time becomes one day shorter.

These one-day amounts of power generation and current consumption can be set by measuring the current consumption of the electronic timepiece 1 and calculating power consumption per day, and setting the per-day power generation based on the measured power consumption. This can be difficult to achieve in a small electronic timepiece 1 such as a wristwatch, however, because it requires incorporating a circuit for measuring current consumption.

In this embodiment of the invention, therefore, the typical per-day current consumption of the electronic timepiece 1 is measured and calculated in the factory, and the required daily power generation corresponding to the calculated power consumption is preset and stored in ROM 102, for example. Each time the movement of the electronic timepiece 1 advances normally one day, the amount of current consumed per day is assumed to have been consumed and the continuous operating time counter is decremented one day.

When the electronic timepiece 1 has a high-current-consumption function other than the function for normal movement control, the current consumption per unit time can be preset for each such function, and current consumption can be corrected by multiplying the current consumption per unit time by how long the function is used. For example, if the electronic timepiece 1 has a radio-controlled time correction function that adjusts the time by receiving a radio signal, current consumption during the signal reception process and the time adjustment process can be preset, and the continuous operating time can be corrected based on the calculated power consumption.

The second remaining operating time counter counts a second integral, which accumulates the generated power output after a specific operation, such as after manually generating power by winding the crown 3. Incrementing and decrementing the counter is controlled in the same way as the first remaining operating time counter, and further description thereof is thus omitted.

Remaining Operating Time Display Control Means

The remaining operating time display controller 9 controls the remaining operating time display motor driver 10 based on the output of the integrator 8. More specifically, the remaining operating time display controller 9 reads the continuous operating time counter of the integrator 8, and controls the remaining operating time display motor driver 10 so that the display hand 31 indicates the stored count, that is, the continuous operating time. The display hand 31 normally indicates the continuous operating time stored by the first remaining operating time counter, but the display hand 31 can alternatively display the continuous operating time after a prescribed operation that is stored by the second remaining operating time counter when an external operating member is operated.

Remaining Operating Time Display Motor Drive Means

The remaining operating time display motor driver 10 inputs a drive pulse to the motor coil 111 of the remaining operating time display motor 11 to control driving the remaining operating time display motor 11 based on a drive control signal output from the remaining operating time display controller 9.

Remaining Operating Time Display Motor and Display Hand 31 Drive Wheel Train As shown in FIG. 4, the remaining operating time display motor 11 has a coil block 112 to which the motor coil 111 is wound, and a stator 113 to which a rotor 114 is disposed to rotate freely.

An intermediate wheel 34 meshes with the rotor pinion of the rotor 114, and a display wheel 33 meshes with the pinion of the intermediate wheel 34. The display hand 31 is attached to the display wheel 33. The display hand 31 (auxiliary hand) displays the continuous operating time integrating the generated power.

The display wheel 33 has teeth formed to only a part of the outside edge of the wheel, and can be rotated only within a prescribed angular range by the remaining operating time display motor 11. The display hand 31 that is attached to the display wheel 33 can therefore also rotate only through a prescribed angular range.

The dial 32 is therefore a flat fan shape, and a scale 321 is formed in an arc along the path of the distal end of the display hand 31.

The scale 321 is divided into ten segments ranging from a zero graduation 321A denoting hand position 0 to a tenth graduation 321B denoting hand position 10. The scale 321 therefore has eleven graduations from hand position 0 to hand position 10, and can indicate eleven states.

As shown in FIG. 7, when the continuous operating time kept by the remaining operating time counter is seven days or less, each graduation indicates a continuous operating time equal to one day. When the count is greater than seven days, each graduation indicates a continuous operating time equal to seven days, and a continuous operating time of a maximum 21 days can therefore be indicated.

More specifically, when the count of the remaining operating time counter goes to zero and the movement stops, the display hand 31 points to the zero graduation 321A, that is, 0 (and the displayed value indicates that the sleep mode was entered).

If the display value is between 0 days, that is, a remaining operating time of 0, and one day, the display hand 31 points to display position 1. If the display value is between 1 day, that is, a continuous operating time of one day, and 2 days, the display hand 31 points to display position 2. As the remaining continuous operating time thus continues to increase one day, the display hand 31 moves to display positions 3 to 7.

When the display value is between 7 days indicating a continuous operating time of seven days and 14 days, the display hand 31 points to display position 8, and when the display value is between 14 days indicating a continuous operating time of fourteen days and 21 days, the display hand 31 points to display position 9.

If the display value is greater than 21 days, that is, the remaining continuous operating time is greater than 21 days, the display hand 31 points to display position 10.

When the display hand 31 is pointing to the maximum operating time that can be displayed, which is 21 days in this example, and the remaining operating time goes to a specific value, specifically one day more than the maximum of 22 days, the continuous operating time counter stops integrating any additional charge that is generated. The maximum value stored by the first remaining operating time counter is thus 22 days, and if the continuous operating time is 21 days or 22 days, the display hand 31 points to display position 10.

When the remaining operating time counter steps up because power is generated as described above, the remaining operating time display motor driver 10 moves the display hand 31 one graduation counterclockwise. When power is consumed and the remaining operating time counter steps down, the remaining operating time display motor driver 10 moves the display hand 31 one graduation clockwise.

Timepiece Control Means and Time Display Means

The timepiece control means and time display means for displaying the regular time are the same as in a common analog quartz timepiece, and detailed description thereof is omitted below.

More specifically, the oscillation means 12 is a crystal oscillator, for example, that outputs a signal of a prescribed frequency. The frequency divider 13 frequency divides the signal from the oscillation means 12, and outputs a 1-Hz reference signal in this embodiment of the invention.

The time display controller 14 outputs a drive signal to the time display motor driver 15 based on the reference signal from the frequency divider 13. The drive signal is normally output each time the 1-Hz reference signal is output from the oscillation means 12. The time display motor driver 15 inputs to the motor coil of the time display motor 16 based on the drive signal, and the time display motor 16 moves the hands 20 in steps.

A control signal from the remaining operating time display controller 9 causes the time display motor driver 15 to enter a sleep mode that stops movement of the hands 20 when the remaining continuous operating time goes to 0.

Electronic Timepiece Operation

Figure 8:
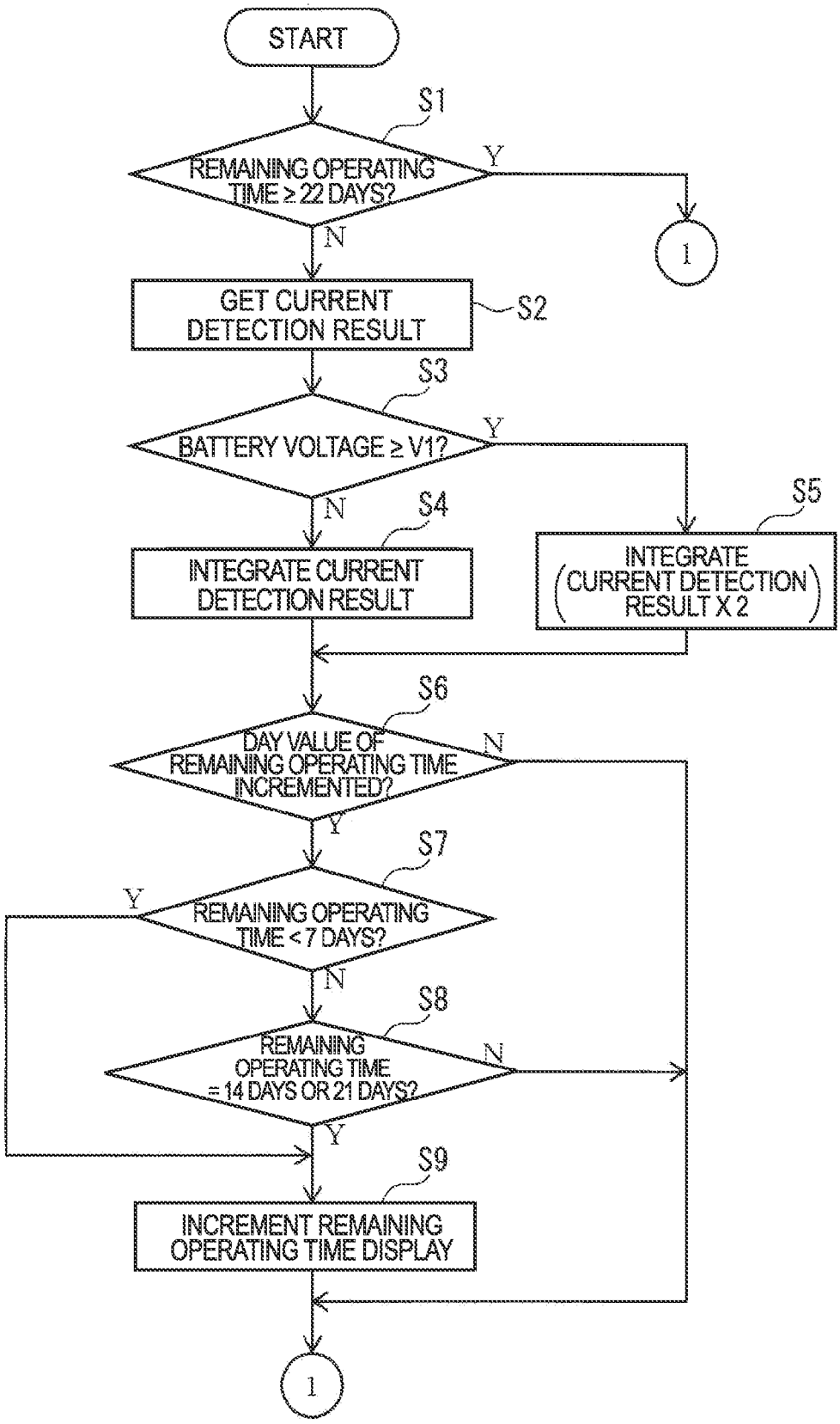
FIG. 8 is a flow chart of the remaining operating time display process in the first embodiment of the invention.
Figure 9:
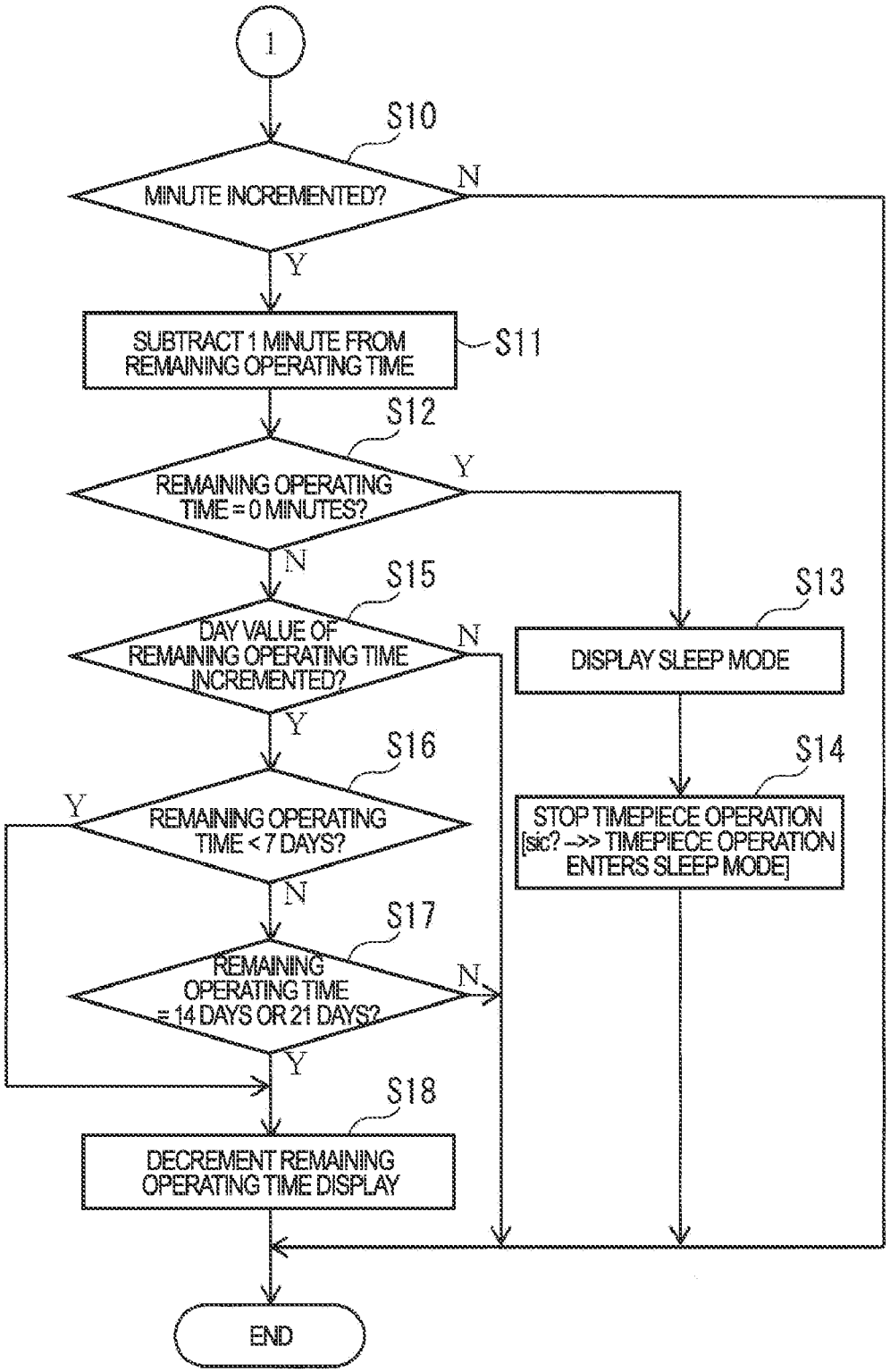
FIG. 9 continues the flow chart in FIG. 8.

The operation of the electronic timepiece 1 according to this embodiment of the invention is described next with reference to the flow charts in FIG. 8 and FIG. 9.

The control described by these flow charts is executed at each sampling time shown in FIG. 6.

When operation of the electronic timepiece 1 starts, the remaining operating time display controller 9 determines if the remaining operating time stored by the remaining operating time counter is greater than or equal to the maximum count, which in this embodiment of the invention is 22 days, that is, one day greater than the maximum displayable value of 21 days (step S1). If the remaining operating time is greater than or equal to 22 days, integration stops and control goes to step S10.

If step S1 returns No, the remaining operating time display controller 9 executes a process that causes the current detector 6 to sample power generation and return the current detection result (step S2). If the generating means 4 generates power as a result of movement of the rotary pendulum 2 or crown 3, the resulting current (charge current) flows through the rectifier 5 to the secondary battery 7 and is detected by the current detector 6. As a result, the detection result signal indicating the current peak of each sample, or more specifically a signal denoting the result of comparison with the threshold levels I1 to I4 as shown in FIG. 6, is output from the current detector 6.

The integrator 8 then determines if the voltage of the secondary battery 7 (battery voltage) is greater than or equal to a prescribed voltage V1 (step S3).

If in step S3 the battery voltage is less than V1, the integrator 8 integrates the detection result signal from the current detector 6 (step S4). Integration is based on 1/256 of the charge equal to current consumption in one minute as the fundamental unit, and the integrator 8 increments the continuous operating time one minute when 256 units are integrated.

For example, if the current consumption in 1 second is 1 μA, the charge consumption in 1 minute is 1 μA×60=60 μC. The basic unit of charge accumulation is therefore 60 μC/256=0.234 μC.

If the detection current based on the detection result signal is 0.5 mA and the sampling interval is 1/32 second, the integral of the detection current detected in each sample is 1000×0.5 mA×1/32 sec×1/0.234 μC=approximately 67.

So that the displayed continuous operating time is not less than the actual remaining operating time due to error when the charge is added in step S4, the integrator 8 in this embodiment of the invention integrates the charge determined by multiplying a prescribed correction coefficient that is less than 1 to the actual generated charge.

For example, if the generator current detection precision is ±5% and the charging efficiency of the secondary battery 7 is a minimum of 90%, the correction coefficient can be set to (1−|±0.05|)×0.9=approximately 0.86.

If the battery voltage is greater than or equal to V1 in step S3, the integrator 8 integrates twice the detection result signal of the current detector 6 (step S5).

Figure 10:
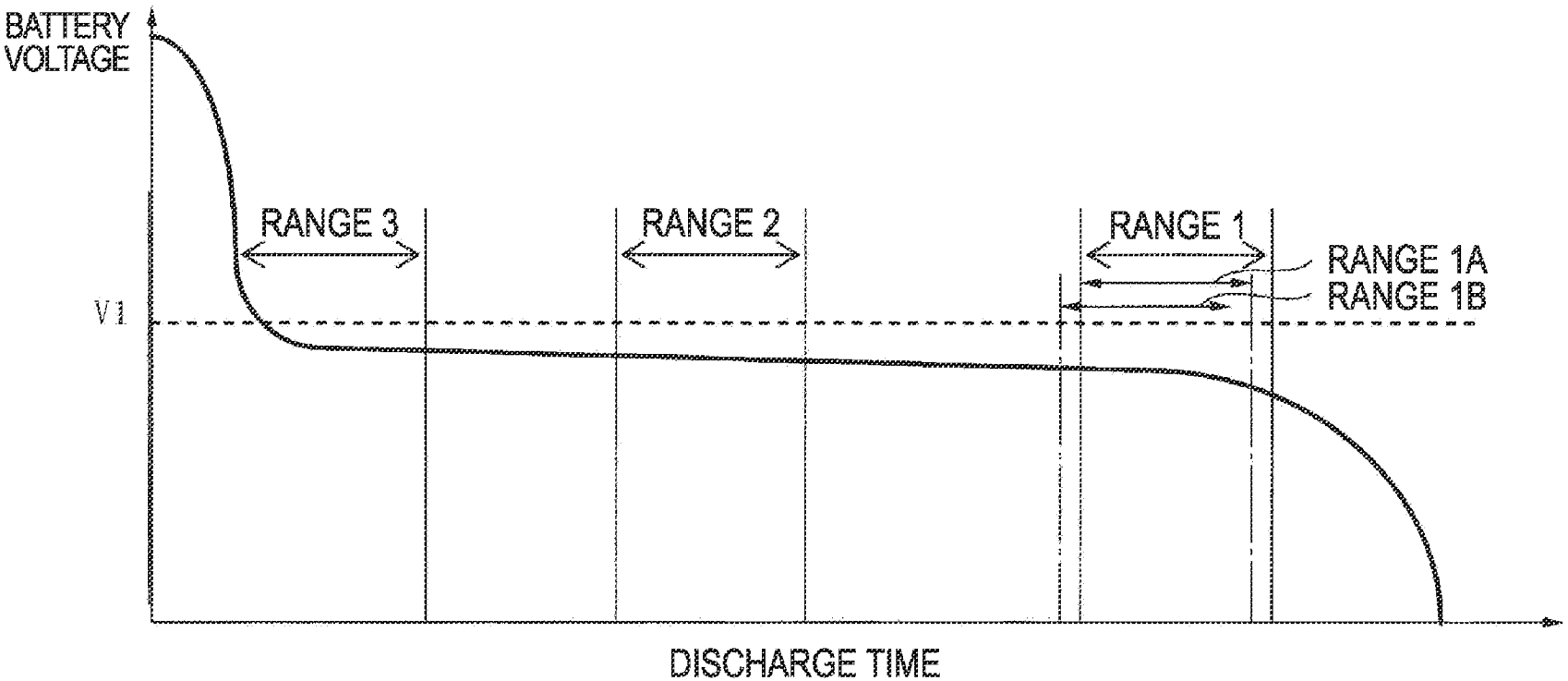
FIG. 10 is a graph showing the discharge characteristic of the secondary battery.

Note that voltage V1 is set to a higher voltage than the usable voltage range of the secondary battery 7. For example, if a lithium ion battery with a flat discharge characteristic as shown in FIG. 10 is used as the secondary battery 7, a voltage that is higher than the flat voltage range where the voltage is substantially constant is set as V1.

The remaining operating time display controller 9 then determines if the day value of the operating time was incremented as a result of integrating the current detection result (step S6). More specifically, the integrator 8 adds 1 minute to the operating time when a charge equal to one minute is generated, and when the sum of this addition is equal to 24 hours, that is, one day, 1 day is added to the remaining operating time and the day digit of the operating time is thus incremented.

If step S6 returns Yes, the remaining operating time display controller 9 determines if the remaining operating time is less than or equal to 7 days (step S7).

If step S7 returns No, the remaining operating time display controller 9 determines if the remaining operating time is 14 days or 21 days (step S8).

If step S7 returns Yes, that is, step S6 determines the day digit increased and the remaining operating time is less than or equal to 7 days, the remaining operating time display controller 9 moves the display hand 31 one step (one graduation) forward and thus increments the display one graduation (step S9).

If step S7 determines the remaining operating time is greater than 7 days, the displayed value is incremented one graduation only if step S8 determines the remaining operating time has increased to 14 days or 21 days as a result of incrementing the day digit (step S9).

If step S6 returns No because the day digit did not rise, or step S8 returns No because the remaining operating time is not 14 or 21 days, the displayed value does not change.

The remaining operating time display controller 9 then determines if the time display controller 14 incremented the minute (step S10). More specifically, because incrementing the minute occurs once a minute due to the passage of time and the remaining operating time display control process shown in FIG. 8 and FIG. 9 is executed at a sampling rate that is shorter than one minute, step S10 detects if the minute was incremented at a rate of once in plural processes.

If step S10 determines that the minute changed, the current required to advance the movement one minute has been consumed, and the remaining operating time display controller 9 therefore subtracts the 256 units equal to a remaining operating time of one minute from the stored count (step S11). The integral stored by the first remaining operating time counter is thus reduced 256 units when the minute value of the time increases.

The integrator 8 then determines if the count (remaining operating time) went to 0 as a result of decrementing the time (step S12).

If the count goes to 0, the integrator 8 drives the display hand 31 in reverse by means of the remaining operating time display controller 9 to point to 0 (zero graduation 321A) to indicate that the sleep mode was entered (step S13).

The integrator 8 also stops the movement, that is, timepiece operation, (step S14) and the control process for one sampling cycle ends.

When timepiece operation thus stops in this embodiment of the invention, the time display motor driver 15 stops operating and moving the hands 20 stops, but counting the time (timekeeping) by the oscillation means 12, frequency divider 13, and time display controller 14 continues so that when power is generated and stored the displayed time can be quickly and automatically reset to the current time.

Operation of the oscillation means 12, frequency divider 13, and time display controller 14 could also be stopped in step S14 to further reduce power consumption.

If the count has not gone to 0, the remaining operating time display controller 9 determines if the day digit of the remaining operating time decreased as a result of the subtraction in step S11 (step S15). For example, if power generation has stopped, the remaining operating time decreases one minute with each one passing minute, and when the total subtracted amount equals 24 hours or one day, the remaining operating time decreases one day and the day digit is decremented. When power is generated but the operating time added as a result of power generation minus the operating time subtracted due to operation of the movement results in a decrease of one day, the day digit is decremented.

If step S15 returns Yes, the remaining operating time display controller 9 determines if the remaining operating time has gone to seven days or less due to decrementing the day value (step S16).

If step S16 returns No, the remaining operating time display controller 9 determines if the remaining operating time has gone to 14 days or 21 days as a result of decrementing the day digit (step S17).

If step S16 returns Yes because the day digit was decremented and the remaining operating time is now 7 days or less, the remaining operating time display controller 9 drives the display hand 31 in reverse one step (one graduation) and the displayed value is reduced one step (step S18).

If in step S16 the remaining operating time is greater than 7 days, the display is decremented one graduation (step S18) only if the remaining operating time has gone to 14 days or 21 days, and the control process executed in one sampling period ends.

If step S10, S15, or S17 returns No, the display hand 31 does not move and the control process executed at in sampling period ends.

As a result, if a secondary battery 7 with a storage capacity greater than the charge consumed in 22 days is used, the displayed remaining operating time goes to 0 and the sleep mode is entered before the secondary battery 7 is depleted.

Furthermore, by applying a coefficient less than 1 to the generated charge in the integration step (S4), the usable range of the secondary battery 7 can be gradually shifted from range 1 to a higher voltage range such as range 2 and then range 3 as shown in FIG. 10.

For example, if power is generated to produce a current charge of one day but a coefficient of less than 1 (such as 0.8 in this example) is applied, the calculated remaining operating time is 0.8 day. If the current charge is equal to 1.25 days, the calculated remaining operating time is 1 day.

As a result, if charging starts when the voltage of the secondary battery 7 is less than the lower limit of the used voltage range 1, a remaining operating time of one day (a current charge of 1.25 days) is added, and the voltage rises to the upper limit of range 1. If the movement then advances one day without additional power being generated and the remaining operating time is reduced one day, the voltage range of the secondary battery 7 that is used at this time is range 1A and the lower limit of this range is a voltage higher than the lower limit of range 1. If power is again generated and the remaining operating time increases one day, the stored voltage is higher than the voltage at the upper limit of range 1. As a result, the range 1B that is then used to drive the movement is shifted overall to a higher level than the voltage limits of range 1A. By thus applying a small coefficient when integrating the generated charge, the range of the secondary battery 7 that is used shifts to a higher voltage range. The amount of this shift decreases as the coefficient approaches 1 and increases as the coefficient approaches 0, and the offset can therefore be controlled by setting the coefficient.

Because the integral is corrected by doubling in step S5 if the battery voltage exceeds V1, shifting to a higher voltage stops. More specifically, if the coefficient used for integration is greater than 1, the increase in the remaining operating time is greater than the actual voltage increase. In other words, if the battery is charged more than the charge that is actually consumed to drive the movement one day, the integrated remaining operating time is twice that amount or two days. As a result, if driving the movement decreases the remaining operating time and the remaining operating time counter counts down one day, the actual stored voltage returns to the voltage that was stored before power was generated. However, because an operating time equal to one day remains, the movement does not stop and continues operating. The used voltage range therefore shifts to the low voltage side and shifting to the high voltage side stops.

The invention described above has the following effects.

(1) By having a current detector 6 that detects the charge current input to the secondary battery 7, that is, detects the generator output, and an integrator 8 that integrates the detection result signal from the current detector 6 and calculates the remaining operating time, the remaining operating time can be detected and displayed more accurately than an arrangement in which the voltage of the secondary battery 7 is detected to calculate the remaining operating time.

(2) The first remaining operating time counter increases the remaining operating time by an equivalent amount when power equal to a prescribed operating time is generated, and decreases the remaining operating time by an equivalent amount when power equal to a prescribed operating time is consumed by driving the movement, for example. As a result, this aspect of the invention can always keep the remaining operating time accurate and reduce the processor load because operation is possible using a simple algorithm.

(3) This embodiment of the invention stops driving the time display motor driver 15 and stops operating the movement when the remaining operating time goes to 0. As a result, the actual remaining operating time (the remaining continuous operating time until the movement stops) therefore completely matches the remaining operating time that is displayed, the user can accurately determine how much time is left until the movement stops, and convenience is thus improved.

(4) This aspect of the invention can also be configured so that the secondary battery 7 stores sufficient voltage to operate the electronic timepiece 1 normally when the remaining operating time goes to 0. If power is then generated, the electronic timepiece 1 can be quickly restored to a stable operating state from the sleep mode, the user can quickly know the time, and convenience can be improved.

(5) The integrator 8 uses 1/256 of the charge equal to the power consumption in one minute as the integration unit (fundamental unit), increments the fundamental unit by one each time power equal to the fundamental unit of integration is produced, and adds one to the remaining operating time each time 256 units are integrated. Both processing and the circuit can thus be simplified. Processing by means of an IC is further simplified because the fundamental unit is set to 1/(2 to the 8th), and binary processing is therefore possible.

(6) Because the current detector 6 has a peak detection circuit 62, the need for a capacitor can be eliminated, the hardware configuration can be simplified, and detection with no delay is possible.

(7) Because the integrator 8 is controlled to stop integration when the remaining operating time in step S1 is greater than or equal to 22 days, the usable range of the secondary battery 7 can be shifted to the high voltage side and the risk of total battery discharge can be reduced accordingly. In addition, the remaining operating time display can be prevented from stopping for a long time, and the user can thus be prevented from thinking that the display is broken.

(8) Because the integrator 8 uses a coefficient of less than one to integrate the generator output, the usable range of the storage means can be shifted to the high voltage side, and the timepiece can be prevented from stopping before the remaining operating time display goes to 0.

In addition, if the secondary battery 7 voltage is greater than or equal to a predetermined voltage V1, the integrator 8 adds a value corrected by applying a coefficient greater than 1 to the generator output (a coefficient of 2 in this embodiment). As a result, the remaining operating time appears to continue increasing even if the secondary battery 7 voltage is high and the generator output is low relative to the stored charge. The remaining operating time display can therefore continue to change, the increase in the remaining operating time can increase relative to the actual voltage rise in the high voltage range of the secondary battery 7, and the range of actual battery usage can be prevented from shifting further to the high voltage side.

(9) If the remaining operating time is less than or equal to 7 days, the remaining operating time display controller 9 uses one graduation to indicate one day, and if the remaining operating time is greater than 7 days, uses one graduation to indicate 7 days, that is, 14 days and 21 days. A relatively long remaining operating time of 21 days can therefore be displayed, the remaining operating time can be indicated using a shorter interval (a 1-day interval) when the operating time becomes shorter, the remaining operating time can therefore be appropriately displayed for the user, and convenience is improved.

(10) A remaining operating time of 0 and when the sleep mode is entered are indicated by different display positions 1 and 0, respectively, as shown in FIG. 7. The user can therefore easily know if the remaining operating time is 0 days, that is, between zero and one day, or if the remaining operating time is less than zero and the electronic timepiece 1 has stopped.

Second Embodiment

Figure 11:
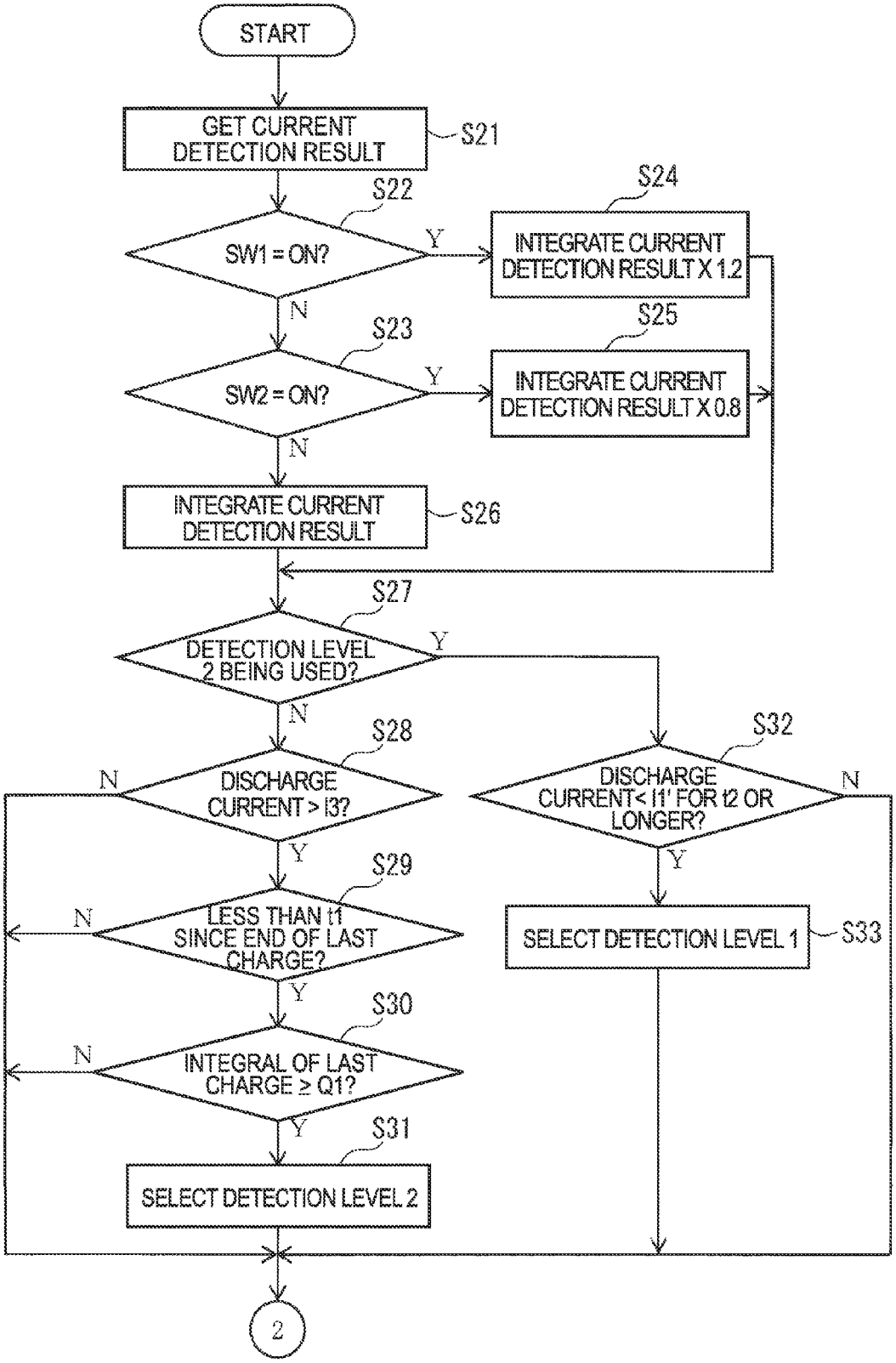
FIG. 11 is a flow chart of the process executed in the second embodiment of the invention.
Figure 12:
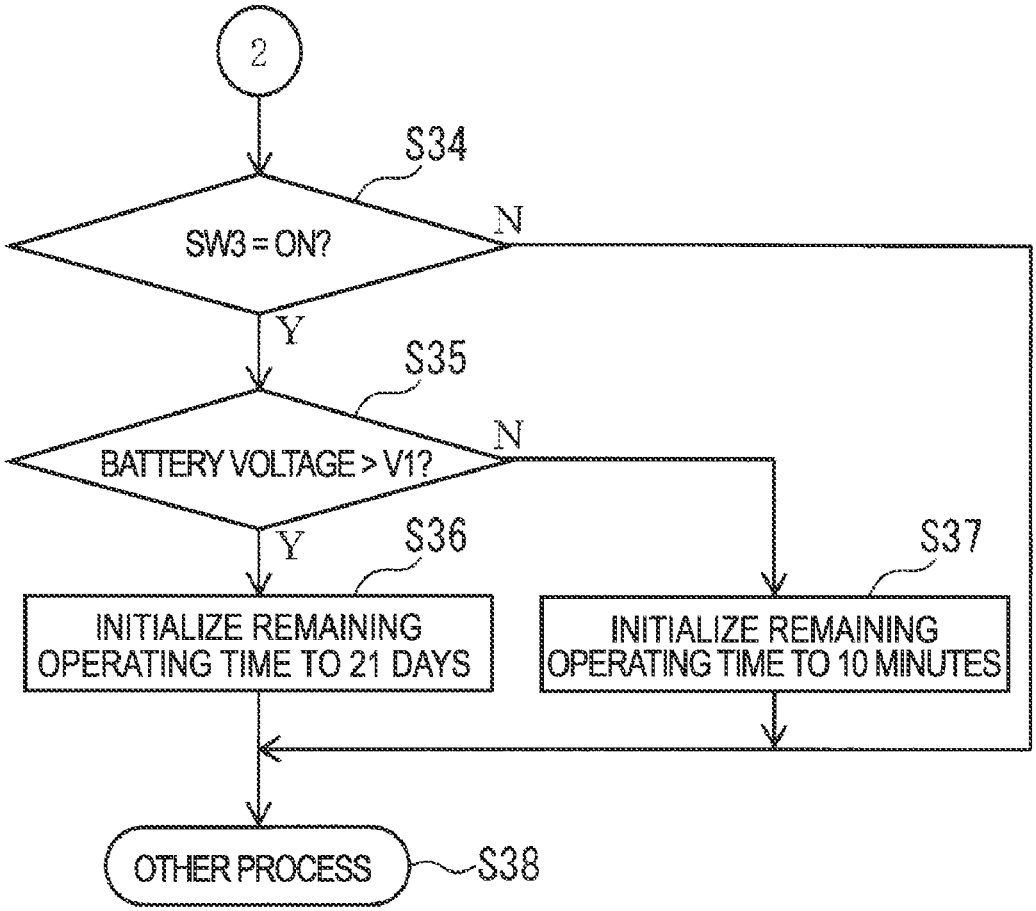
FIG. 12 continues the flow chart in FIG. 11.

A second embodiment of the invention is described next with reference to FIG. 11 to FIG. 13.

This second embodiment differs from the first embodiment in the addition of three features, that is, the detection level used by the current detector 6 automatically changes when power is generated by automatic winding during the course of using the timepiece normally and when the battery is rapidly recharged by manually winding, the integration level can be fine tuned using switch SW1 and switch SW2 to reflect differences between individual products, and the system can be reinitialized by manually turning switch SW3 on. Other aspects of this embodiment are identical to the first embodiment, and further description thereof is omitted.

Figure 13:
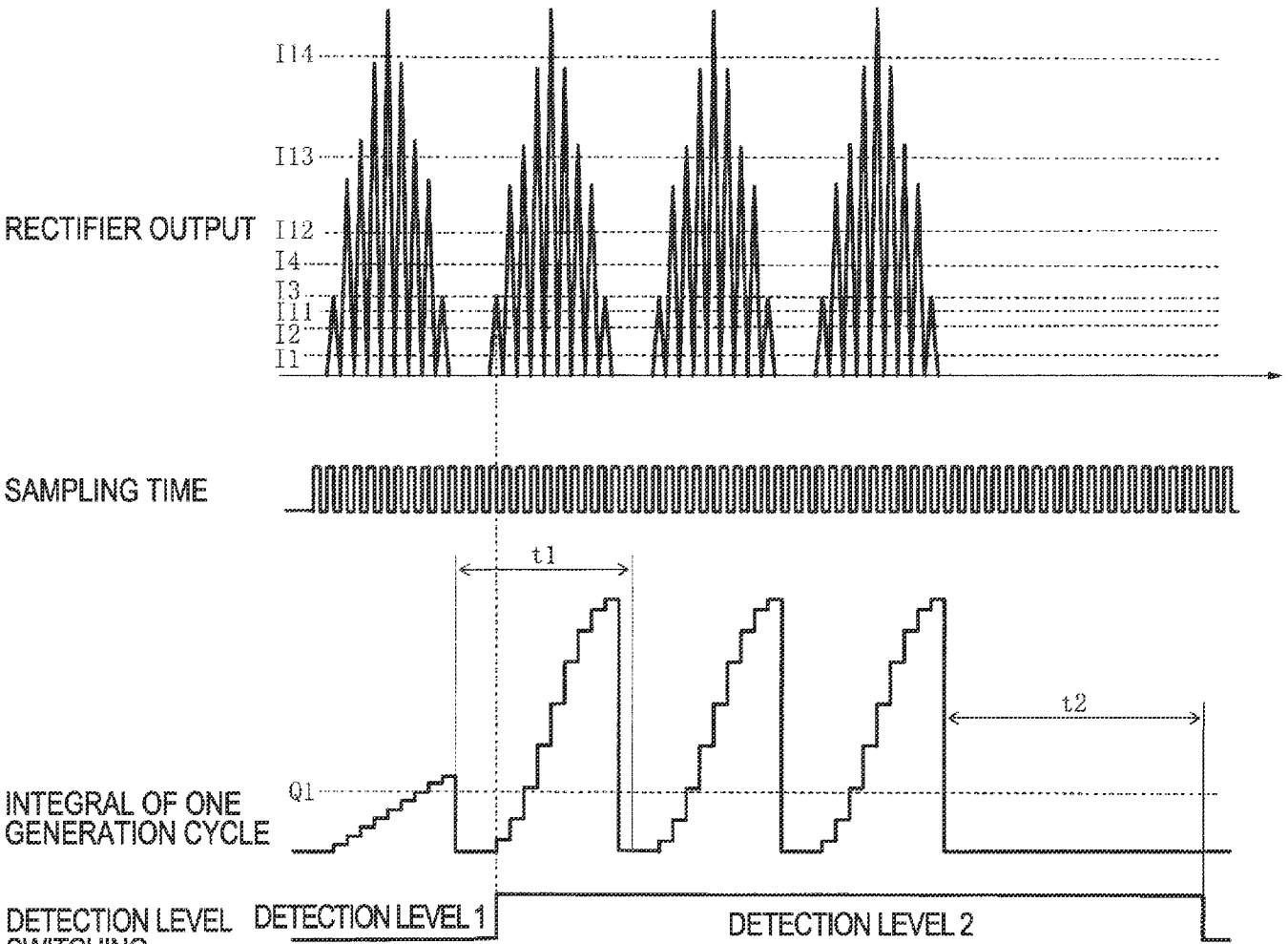
FIG. 13 is a timing chart showing the relationship between power generation, the integral of one power generation cycle, and the accumulated charge in the second embodiment of the invention.

The current detector 6 is initially set to detection level 1 in which I1 to I4 are used as the detection thresholds as shown in FIG. 13, and detects the current level charged from the power generator 4 to the secondary battery 7 using this detection level 1.

The integrator 8 reads the current detection result from the current detector 6 (step S21). The integrator 8 then detects if SW1 is on (step S22), and if SW1 is not on detects if SW2 is on (step S23).

When switch SW1 is on, the integrator 8 integrates 1.2 times the current detection result (step S24), and integrates 0.8 time the current detection result when SW2 is on (step S25).

If neither SW1 nor SW2 is on, the integrator 8 integrates the current detection result directly (step S26).

Because switches SW1 and SW2 are set based on the difference between an individual electronic timepiece 1 and a reference standard, the switches are disposed to an internal circuit board of the timepiece, and are set (turned on or off) in the factory after measuring the individual difference of the particular electronic timepiece 1.

Whether detection level 2 is currently selected as the detection level of the current detector 6 is then determined (step S27).

If step S27 determines that detection level 2 is not selected, whether the charge current exceeds threshold value I3 of detection level 1 is determined (step S28). If step S28 returns Yes, whether the time passed since the end of the last charging operation ended is within a prescribed time t1 is determined (step S29). If step S29 returns Yes, whether the integral of the previous charging operation is greater than or equal to a prescribed output level Q1 is determined (step S30).

If step S30 returns Yes, the current detector 6 selects detection level 2 (step S31).

More specifically, as shown in FIG. 13, detection level 1 (I1 to I4) is normally selected, but detection level 2 (I11 to I14) is selected if the following conditions are met.

More specifically, if the charge current is greater than or equal to I3, generator output from the previous winding (output from when the current detection result goes to I1 or above until dropping to I1 or below) is greater than or equal to threshold value Q1, and it is within prescribed time t1 since the end of the last generation cycle (the time since the current detection result returned to I1 or below), detection level 2 is selected for use (step S31).

This causes the display to change after the second revolution when the user turns the crown 3 more quickly than a prescribed level.

If detection level 2 is selected, the current detector 6 sets current levels I11, I12, I13, and I14 as the threshold values as shown in FIG. 13.

This changes the current detection level from levels I1 to I4 (detection level 1), which the levels that are suitable for detecting the generated current when the generator winds automatically during normal use, to detection levels I11 to I14 (detection level 2), which are the levels that are suitable for detecting the generated current when the generator is wound manually and during rapid charging in the automatic winding mode.

If steps S28 to S30 return No, the detection level is not changed in step S31 and detection level 1 remains selected.

If step S27 returns Yes, whether the charge current is less than I11 continuously for a prescribed time t2 or longer is determined (step S32).

If step S32 returns Yes, the output current level of the generator is not as high as is typical of rapid charging in the automatic winding mode or manual winding, and the detection level is reset to detection level 1 (step S33).

If step S32 returns No, the detection level is not changed in step S33 and remains set to detection level 2.

The remaining operating time display controller 9 then detects if switch SW3 is on (step S34).

If switch SW3 is on, whether the battery voltage is greater than or equal to V1 is detected (step S35). If step S35 returns Yes, the secondary battery 7 voltage is sufficiently high as shown in FIG. 10, the remaining operating time is sufficient, and the remaining operating time is initialized to the maximum of 21 days (step S36).

If step S35 returns No, the remaining operating time is initialized to the minimum time, such as 10 minutes (step S37).

The movement soon stops if the remaining operating time is 10 minutes, but because the user turns the switch SW3 on by operating an external operating member, the user also knows immediately that the remaining operating time is only 10 minutes. As a result, the user can wind the crown 3 or otherwise drive the generator to charge the battery to assure a sufficient charge, the remaining operating time is thus incremented, and the movement is prevented from soon stopping.

Operation then continues in step S38 with another process such as the remaining operating time display process described above in the first embodiment.

In addition to the effects of the first embodiment described above, this second embodiment of the invention has the following effect.

(11) Because the integral of the generator output is corrected based on the on/off state of switch SW1 and SW2 in steps S22 to S25, the integral can be corrected to account for deviation between different electronic timepieces 1, the remaining operating time can be set to match the actual remaining operating time of the particular product, and the accurate remaining operating time can be calculated and displayed.

(12) The detection level used by the current detector 6 can be changed. As a result, the detection level can be set according to the present charging method when charging methods resulting in greatly different generator output (generated current) are used, the system can be simplified, and the charge can be accurately integrated.

More particularly, because detection level 2 is selected when all of the conditions tested in steps S28 to S30 are met, an electronic timepiece 1 that has both an automatic-winding charging mode and a manual-winding charging mode can hold detection level 1 in the automatic winding generator mode whereby power is generated at indeterminate intervals during normal use, can change to a detection level 2 that is appropriate to the charging state when the user shakes the electronic timepiece 1 to rapidly charge the battery in the automatic winding mode or winds the crown 3 in the manual winding mode, and generator output can therefore be detected more accurately.

In addition, when the charge current is continuously less than or equal to I11 for time t2 or longer, that is, when the battery is not charged in the manual winding or rapid automatic winding mode, detection level 1 is automatically reset. The user therefore does not need to manually reset the detection level, and convenience is improved.

(13) If the switch SW3 is turned on by an external operating member and the secondary battery 7 voltage is greater than V1, the remaining operating time is initialized to 21 days. Driving the movement can therefore resume immediately, the user is not prompted to charge the battery because the secondary battery 7 voltage is already in the high voltage range, and generating power unnecessarily can therefore be prevented.

In addition, if the secondary battery 7 voltage is less than or equal to V1, the remaining operating time is initialized to the minimum time of 10 minutes. Driving the movement can therefore resume immediately while also prompting the user to generate power and charge the battery.

The invention is not limited to the embodiment described above, and variations and modifications achieving the same object are included in the scope of the present invention.

Figure 14:
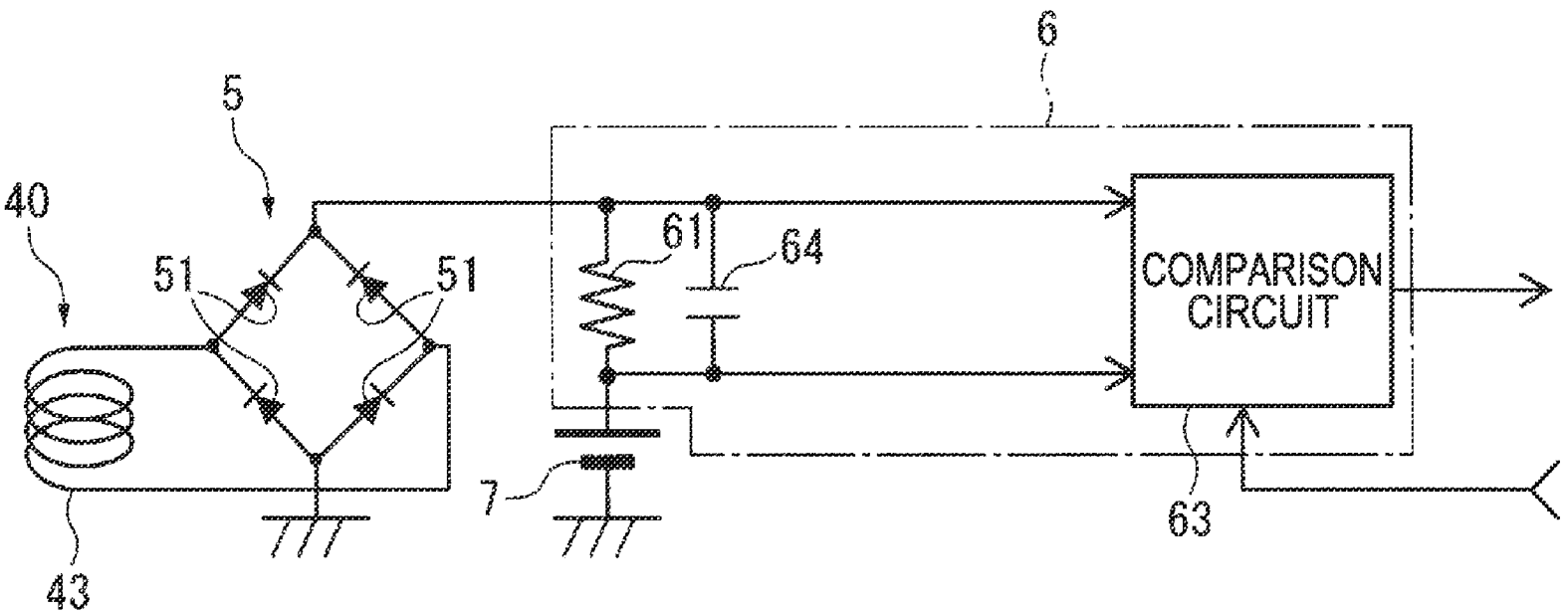
FIG. 14 is a circuit diagram showing of the rectifier means and current detection means in an alternative embodiment of the invention.

As shown in FIG. 14, the current detector 6 can be rendered with a capacitor 64 connected parallel to the resistor 61, and used to detect the average charge current. This arrangement integrates and averages the charge current by means of the capacitor 64, and can therefore detect how much the secondary battery 7 is charged per unit time by means of a simple process.

The conditions for changing the detection level used by the current detector 6 are not limited to those described in the second embodiment, and can be set appropriately according to the characteristics of the generator 40, for example.

For example, if a prescribed charge current (such as I4) is detected when in the continuous operating time display mode, operation can be immediately switched to detection level 2. This enables changing the detection level more quickly than the second embodiment described above. In the foregoing second embodiment the generator 40 can generate power as a result of both automatic winding and manual winding in the foregoing embodiment, and in order to detect generator output as a result of manual winding and rapid self-winding, these conditions are set based on the output characteristics in these generating modes. However, if only a self-winding generator is used, transition conditions that account for manual winding need not be set, and the detection level can be changed by simply detecting if the charge current is greater than or equal to a prescribed threshold value (such as I4).

The detection level can also be changed if generator output is at a prescribed level for a prescribed time or longer within a set period. For example, detection level 2 could be applied if a charge current of I2 or greater is detected three or more times within one second, and this detection state continues for five seconds or longer.

These transition conditions are particularly effective when a generator that produces a constant output level for a extended period of time is used, such as a solar generator or generation by means of an external AC field.

Operation can also be changed to detection level 2 if a prescribed charge (such as Q1) is produced by a single generation cycle, and this repeats a prescribed number of times (such as twice) within a prescribed time (such as one second).

These transition conditions enable quickly switching to detection level 2 when power is produced a specific number of times within a prescribed time, such as with manual winding, and impedes switching to detection level 2 and holds detection level 1 when power is produced at irregular intervals, such as with a self-winding generator that operates intermittently during normal use.

The foregoing embodiments display only the remaining operating time from when the system starts until the system stops (the integral stored by the first remaining operating time counter), but operation could also be switched to display the remaining operating time added after a specific operation (the integral stored by the second remaining operating time counter).

The method of indicating the remaining operating time by means of the display hand 31 can also be reset when the remaining operating time becomes short so that, for example, the remaining operating time can be displayed with greater precision in hour units or minute units.

For example, when the remaining operating time drops to one day, the hand positions 0 to 10 can be reallocated to indicate 0, 1, 2, 3, 4, 5, 6, 7, 14, 19, and 24 hours, respectively, and when the remaining operating time drops to one hour, the hand positions 0 to 10 can be reallocated to indicate 0, 3, 6, 12, 15, 20, 25, 30, 45, and 60 minutes, respectively.

Because the invention stops the movement when the remaining operating time goes to 0, this arrangement enables the remaining operating time to accurately indicate how much longer the movement can continue operating. By displaying the remaining operating time in hour units or minute units, the user can accurately know how much longer the movement will continue operating, and can generate power to charge battery before the movement stops.

When the remaining operating time goes to 0, the foregoing embodiments stop the time display motor driver 15 and time display motor 16 and stop displaying the time by means of the hands 20, but continue driving the oscillation means 12, frequency divider 13, and time display controller 14 to continue keeping the time internally so that the displayed time can be reset to the current time when a prescribed amount of power is generated. Driving the oscillation means 12, frequency divider 13, and time display controller 14 can also be stopped, however, so that all timepiece operations stop.

Another arrangement can also enable the user to selectively control whether the operating mode entered when the remaining operating time goes to 0 is the sleep mode described above or a full stop mode in which all timepiece operations stop.

If current consumption increases due, for example, to outputting drive correction pulses in a drive correction mode, the remaining operating time can also be reduced accordingly and corrected.

More specifically, the time display motor driver 15 can be configured to execute a drive correction process whereby the time display motor driver 15 detects the rotation state of the time display motor 16 after applying a drive pulse to the motor 16, and applies a drive correction pulse if the motor is not turning in order to make the motor 16 start turning. The integrator 8 can then correct the remaining operating time based on the number of times this drive correction process executes, or more specifically shorten the remaining operating time according to the increased current consumption.

Because correction is based on how many times the drive correction process executes, the remaining operating time can be corrected to account for the current consumed by the drive correction process, and the movement can be reliably prevented from stopping before the remaining operating time goes to 0.

In order to completely prevent the battery voltage from going to or below the voltage at which operation stops or sleeps before the remaining operating time display goes to 0, the remaining operating time can be corrected when the battery voltage goes to or below a prescribed level.

More specifically, if the secondary battery 7 voltage is near the low end of range 1 in FIG. 10, the remaining operating time can be shortened to prevent the battery voltage from going to or below the voltage at which operation stops or sleeps before the remaining operating time display goes to 0.

The remaining operating time display means is not limited to a display hand 31 that can move only through a limited angular range, and a display hand 31 disposed to rotate one full revolution (360 degrees) can be used.

However, moving the display hand 31 through a limited angular range as in the foregoing embodiment enables using a larger hand and thereby improves readability when the display hand 31 is disposed as an auxiliary hand in a subdial on the main dial of the timepiece 1.

The remaining operating time display means is also not limited to a display hand 31 as described above, and the remaining operating time can be displayed using a digital or analog display presented in a liquid crystal display or other display means. More particularly, because the invention enables the remaining operating time to accurately display the remaining continuous operating time, the accurate remaining operating time can be displayed for the user by digitally displaying the remaining operating time.

The generator 40 is also not limited to a manually wound generator or a self-winding generator as described above, and various other types of generators can be used, including a generator that operates using an external AC field, a solar generator, and a thermoelectric generator. In addition, the electronic timepiece 1 could incorporate a single type of generator or plural different types of generator assemblies as in the foregoing embodiment.

The invention is also not limited to use in a wristwatch, and can be used in other types of timepieces having an internal generator, including pocket watches, table clocks, and wall clocks.

More specifically, the invention can be used widely in electronic timepieces that have a generator function and a remaining operating time display means for displaying the remaining operating time.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic timepiece with a generator function, comprising:

a generating means;

a storage means that stores electrical energy produced by the generating means;

a timekeeping control means that is driven by the electrical energy stored in the storage means;

a time display means that is controlled by the timekeeping control means and displays time;

a memory means that stores a predetermined relationship between peak values and corresponding average values of an electrical characteristic of power output by the generator means;

a generator output detection means samples the electrical characteristic of the power output by the generating means, detects a peak value of the electrical characteristic in each sampling period, and retrieves from the memory means an average value corresponding to each of the detected peak values of the electrical characteristic;

a remaining operating time calculation means that integrates one or more of the average values, and calculates a remaining operating time based on the integration; and a remaining operating time display means that displays the remaining operating time calculated by the remaining operating time calculation means.

2. The electronic timepiece with a generator function described in claim 1, wherein:

the predetermined relationship includes information indicative of the current consumption per prescribed time of the electronic timepiece and the remaining operating time calculation means has a remaining operating time counter that increments the remaining operating time by this prescribed time each time the generator output detection means detects a peak value equivalent to this current consumption per prescribed time.

3. The electronic timepiece with a generator function described in claim 2, wherein:

the remaining operating time calculation means decreases the count stored by the remaining operating time counter by a prescribed time each time the prescribed time passes when the timepiece movement continues operating; and the timekeeping control means stops driving the time display means when the count of the remaining operating time counter goes to 0.

4. The electronic timepiece with a generator function described in claim 2, wherein:

the remaining operating time calculation means uses an integer multiple or a 1/integer fraction of the current consumption by the electronic timepiece per prescribed time as the integration unit, converts each peak value detected by the generator output detection means to one or more integration units, and integrates based on the one or more integration units to calculate the remaining operating time.

5. The electronic timepiece with a generator function described in claim 2, wherein:

the remaining operating time display means displays differently than the normal remaining operating time display when the remaining operating time calculated by the remaining operating time calculation means is 0 or less.

6. The electronic timepiece with a generator function described in claim 2, wherein:

the timekeeping control means stops the time display means and continues keeping the time when the remaining operating time is less than or equal to 0, and drives the time display means and resumes displaying the current time when power is generated and the remaining operating time becomes greater than 0.

7. The electronic timepiece with a generator function described in claim 2, wherein:

the time display means includes a motor drive means, a motor that is driven by the motor drive means, and a hand that is moved by the motor;

the motor drive means can execute a drive correction process to detect motor rotation after inputting a drive pulse to the motor, and input a drive correction pulse to turn the motor if motor rotation is not detected; and the remaining operating time calculation means corrects the remaining operating time based on how many times the drive correction process was executed.

8. The electronic timepiece with a generator function described in claim 1, wherein the electrical characteristic of the power generated by the generating means is the current output by the generating means.

9. The electronic timepiece with a generator function described in claim 1, wherein:

memory means stores a result of the integration of the electrical characteristic, and the remaining operating time calculation means does not continue integrating the electrical characteristic if the stored integral has reached an upper limit.

10. The electronic timepiece with a generator function described in claim 1, wherein:

the remaining operating time calculation means multiplies the electrical characteristic by a prescribed coefficient and integrates the result to calculate the remaining operating time.

11. The electronic timepiece with a generator function described in claim 1, wherein:

the remaining operating time calculation means can separately calculate a first integral and a second integral, the first integral integrating the electrical characteristic from when the timekeeping control means starts and the remaining operating time is reset to 0, and the second integral integrating the electrical characteristic from when a prescribed operation occurs; and the remaining operating time display means can switch between displaying remaining operating time based on the first integral and the second integral.

12. The electronic timepiece with a generator function described in claim 1, wherein:

the remaining operating time display means uses a larger display unit to display the remaining operating time when the remaining operating time calculated by the remaining operating time calculation means is greater than a prescribed time than when the calculated remaining operating time is less than the prescribed time.

13. The electronic timepiece with a generator function described in claim 1, wherein:

the remaining operating time calculation means can correct the integral of generator output.

14. The electronic timepiece with a generator function described in claim 1, wherein:

the remaining operating time calculation means detects the voltage of the storage means, and corrects the integral to a value corresponding to an operating time based on the detected voltage if the remaining operating time estimated based on the detected voltage is shorter than the remaining operating time based on the integral calculated by the remaining operating time calculation means.

15. The electronic timepiece with a generator function described in claim 1, wherein:

the remaining operating time calculation means detects the voltage of the storage means, and corrects the average current values added for integration based on the generator output if the detected voltage is greater than or equal to a prescribed voltage.

16. The electronic timepiece with a generator function described in claim 1, wherein:

the generator output detection means sets a detection level according to the generating pattern of the generating means.

17. The electronic timepiece with a generator function described in claim 1, wherein:

the generator output detection means changes a detection level if a prescribed output of the electrical characteristic is detected.

18. The electronic timepiece with a generator function described in claim 1, wherein:

the generator output detection means changes a detection level when a state in which generating a prescribed output of the electrical characteristic within a prescribed time continues for a prescribed time or longer.

19. The electronic timepiece with a generator function described in claim 1, wherein:

the generator output detection means changes a detection level when a prescribed output level of the electrical characteristic in one generation cycle occurs a prescribed number of times within a prescribed period.

20. The electronic timepiece with a generator function described in claim 1, wherein:

the generator output detection means changes a detection level when a prescribed output level of the electrical characteristic is generated in one generation cycle and generating the prescribed output level is then detected within a prescribed time.

21. The electronic timepiece with a generator function described in claim 1, further comprising:

an external operating member;

wherein the integral of the remaining operating time calculation means is initialized to a value for a prescribed remaining operating time greater than 0 when there is a specific operation of the external operating member.

22. The electronic timepiece with a generator function described in claim 1, further comprising:

an external operating member;

wherein the voltage of the storage means is detected, and the integral of the remaining operating time calculation means is initialized to a value based on the detected voltage when there is a specific operation of the external operating member.

* * * * *